US008840037B2

(12) United States Patent
Stark et al.

(10) Patent No.: US 8,840,037 B2
(45) Date of Patent: Sep. 23, 2014

(54) ELECTROSPRAY DEVICE AND A METHOD OF ELECTROSPRAYING

(75) Inventors: John P W Stark, London (GB); Mark D Paine, London (GB); Matthew S Alexander, London (GB)

(73) Assignee: Queen Mary & Westfield College, London (GB)

( * ) Notice: Subject to any disclaimer, the term of this patent is extended or adjusted under 35 U.S.C. 154(b) by 741 days.

(21) Appl. No.: 12/096,253

(22) PCT Filed: Dec. 7, 2006

(86) PCT No.: PCT/GB2006/004586
§ 371 (c)(1),
(2), (4) Date: Oct. 27, 2008

(87) PCT Pub. No.: WO2007/066122
PCT Pub. Date: Jun. 14, 2007

(65) Prior Publication Data

US 2009/0152371 A1 Jun. 18, 2009

(30) Foreign Application Priority Data

Dec. 7, 2005 (GB) ..... 0524979.2
Jul. 14, 2006 (GB) ..... 0614072.7

(51) Int. Cl.
*B05B 5/025* (2006.01)
*H01J 49/16* (2006.01)

(52) U.S. Cl.
CPC ..... *B05B 5/0255* (2013.01); *H01J 49/165* (2013.01)
USPC ..... 239/3; 239/101; 239/690; 239/695; 239/708

(58) Field of Classification Search
USPC ..... 239/690–708, 99, 101, 3; 250/288, 282, 250/281
See application file for complete search history.

(56) References Cited

U.S. PATENT DOCUMENTS

| | | | | |
|---|---|---|---|---|
| 5,015,845 | A * | 5/1991 | Allen et al. | 250/288 |
| 5,115,131 | A * | 5/1992 | Jorgenson et al. | 250/288 |
| 5,344,676 | A | 9/1994 | Kim et al. | |
| 6,407,382 | B1 * | 6/2002 | Spangler | 250/286 |
| 6,860,434 | B2 | 3/2005 | Ahn et al. | |
| 7,232,992 | B2 * | 6/2007 | Whitehouse et al. | 250/288 |

(Continued)

FOREIGN PATENT DOCUMENTS

| | | |
|---|---|---|
| DE | 198 06 253 A1 | 8/1999 |
| EP | 0 468 735 A1 | 7/1991 |

(Continued)

OTHER PUBLICATIONS

PCT International Search Report dated Nov. 2, 2007 for PCT/GB2006/004586.

(Continued)

*Primary Examiner* — Steven J Ganey
(74) *Attorney, Agent, or Firm* — Haynes and Boone, LLP

(57) ABSTRACT

An electrospray apparatus for dispensing a controlled volume of liquid in pulses at a constant frequency is provided. The apparatus comprises an emitter (70) having a spray area from which liquid can be sprayed, a means for applying an electric field (78) to liquid in, on or adjacent to the emitter (70). In use, liquid is drawn to the spray area by electrostatic forces and electrospray occurs in pulses at a constant frequency whilst the electric field (78) is applied.

40 Claims, 15 Drawing Sheets

(56) References Cited

U.S. PATENT DOCUMENTS

| | | | | |
|---|---|---|---|---|
| 2001/0032897 | A1 | 10/2001 | Iwata et al. | |
| 2006/0262163 | A1 | 11/2006 | Nishio et al. | |
| 2007/0084999 | A1 * | 4/2007 | Miller et al. | 250/288 |
| 2007/0101934 | A1 | 5/2007 | Nishio et al. | |
| 2010/0155496 | A1 | 6/2010 | Stark et al. | |

FOREIGN PATENT DOCUMENTS

| | | | |
|---|---|---|---|
| EP | 1 205 252 | A1 | 5/2002 |
| EP | 1 595 845 | A1 | 11/2005 |
| EP | 1 788 375 | A1 | 5/2007 |
| EP | 1 832 349 | A1 | 9/2007 |
| EP | 1 963 024 | B1 | 4/2010 |
| EP | 2 162 228 | B1 | 3/2012 |
| JP | 1998-000808 | A | 1/1998 |
| JP | H10166593 | A | 6/1998 |
| JP | H10181025 | A | 7/1998 |
| JP | 2005-058810 | A | 3/2005 |
| KR | 2000-0058944 | | 10/2000 |
| KR | 20050006848 | | 7/2010 |
| WO | 94/12285 | A2 | 6/1994 |
| WO | WO 94/12285 | | 6/1994 |
| WO | WO 98/56894 | | 12/1998 |
| WO | WO 98/58745 | | 12/1998 |
| WO | 01/71311 | A2 | 9/2001 |
| WO | WO 01/71311 | A2 | 9/2001 |
| WO | WO 02/085538 | A2 | 10/2002 |
| WO | WO 02/095362 | A2 | 11/2002 |
| WO | WO 03/000431 | A1 | 1/2003 |
| WO | WO 2005/014179 | A1 | 1/2005 |
| WO | WO 2007/030317 | A2 | 3/2007 |
| WO | WO 2007/066122 | A1 | 6/2007 |

OTHER PUBLICATIONS

GB Search Report dated Mar. 8, 2006 for Application No. GB0524979.2.

Chinese First Office Action mailed Apr. 27, 2010, in counterpart Chinese Patent Application No. 200680050762.6.

Chinese Second Office Action mailed Mar. 15, 2011, in counterpart Chinese Patent Application No. 200680050762.6.

Chinese Third Office Action mailed Nov. 23, 2011, in counterpart Chinese Patent Application No. 200680050762.6.

European Examination Report mailed Apr. 21, 2009, in related European Application No. 06 820 456.9.

European Examination Report mailed Dec. 2, 2008, in related European Application No. 06 820 456.9.

PCT International Search Report of the International Searching Authority in Int'l App No. PCT/GB2008/001708, 5 pages, Oct. 23, 2008.

PCT Written Opinion of the International Searching Authority in Int'l App No. PCT/GB2008/001708, 16 pages.

PCT International Preliminary Report on Patentability of the International Searching Authority in Int'l App No. PCT/GB2008/001708, 17 pages, Nov. 17, 2009.

Examination Report dated May 26, 2010 in EP Application No. 08 750 639.0, 7 pages.

GB Search Report in GB Application No. GB0709517.7, dated Jul. 25, 2007, 4 pages.

GB Search Report in GB Application No. GB0710879,8, dated Aug. 28, 2007, 4 pages.

Restriction Requirement dated May 1, 2013 for U.S. Appl. No. 12/600,625, 8 pages.

Non-Final Office Action dated Jun. 14, 2013 for U.S. Appl. No. 12/600,625, 9 pages.

Office action (Notice of Reasons for Rejection) dated May 31, 2012 in Japanese patent application No. 2008-543902 (2 pages), with translation (4 pages).

Notice of Allowance dated May 25, 2010 in Japanese patent application No. 2008-543902 (2 pages).

Office action (Non-Final Rejection) dated Dec. 7, 2012 in KR patent application No. 10-2008-7016524 (7 pages), with translation (7 pages).

English language Abstract of KR 20000058944 from Espacenet (1 page), Last Updated May 12, 2011.

Notice of Allowance dated Jul. 3, 2013 in KR patent application No. 10-2008-7016524 with translation (3 pages).

M.D. Paine, M.S. Alexander, K. L. Smith, M. Wang, J.P.W. Stark: "Controlled electrospray pulsation for deposition of femtoliter fluid droplets onto surfaces" Journal of Aerosol Science, vol. 38, Mar. 3, 2007, pp. 315-324.

Paine, M.D., et al., "Controlled electrospray pulsation for deposition of femtoliter fluid droplets onto surfaces," ScienceDirect Aerosol Science 38 (2007) 315-324, Journal of Aerosol Science, 10 pages.

English translation of Japanese Office action (Notice of Reasons for Rejection) dated Mar. 5, 2013 in Japanese patent application No. 2010-507984, 4 pages.

English translation of Chinese Office action (Notification of the First Office Action) dated Aug. 1, 2012 in Chinese patent application No. 200880016463.X, 11 pages.

English translation of Chinese Office action (Notification of the Second Office Action) dated Jul. 3, 2013 in Chinese patent application No. 200880016463.X, 6 pages.

European Office action dated May 26, 2010 in European patent application No. 08 750 639.0-2425, 7 pages.

European Office action (Summons to attend oral proceedings) dated Apr. 8, 2011 in European patent application No. 08 750 639.0-2425, 5 pages.

Korean Office Action for Korean Patent Application No. 10-2009-7026237 dated May 29, 2014, 6 pages.

Non-Final Office Action in U.S. Appl. No. 12/600,625 dated Jul. 22, 2014, 10 pages total.

English Abstract for KR 20050006848 dated Jul. 3, 2010 for Applicant Korea Advanced Institute of Science and Technology, 1 page total.

English Translation for KR 20050006848 dated Jul. 3, 2010 for Applicant Korea Advanced Institute of Science and Technology, 12 pages total.

* cited by examiner

Figure 8A
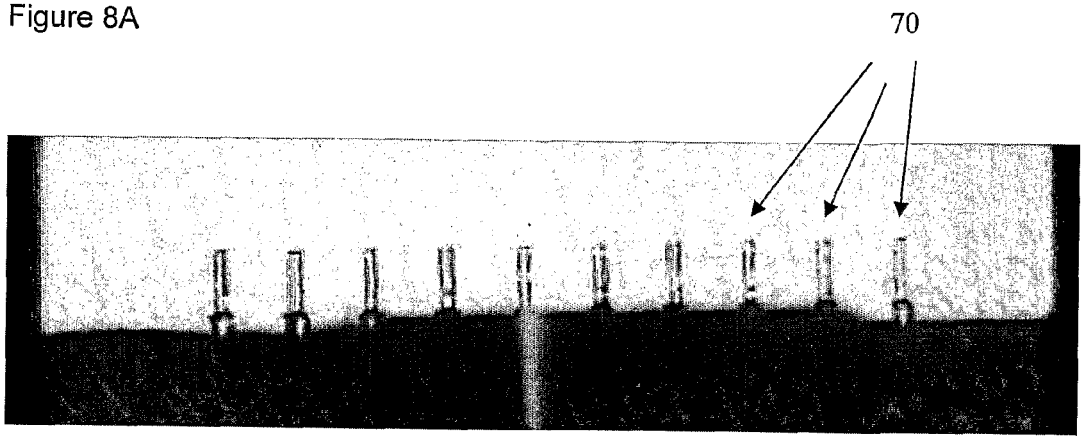
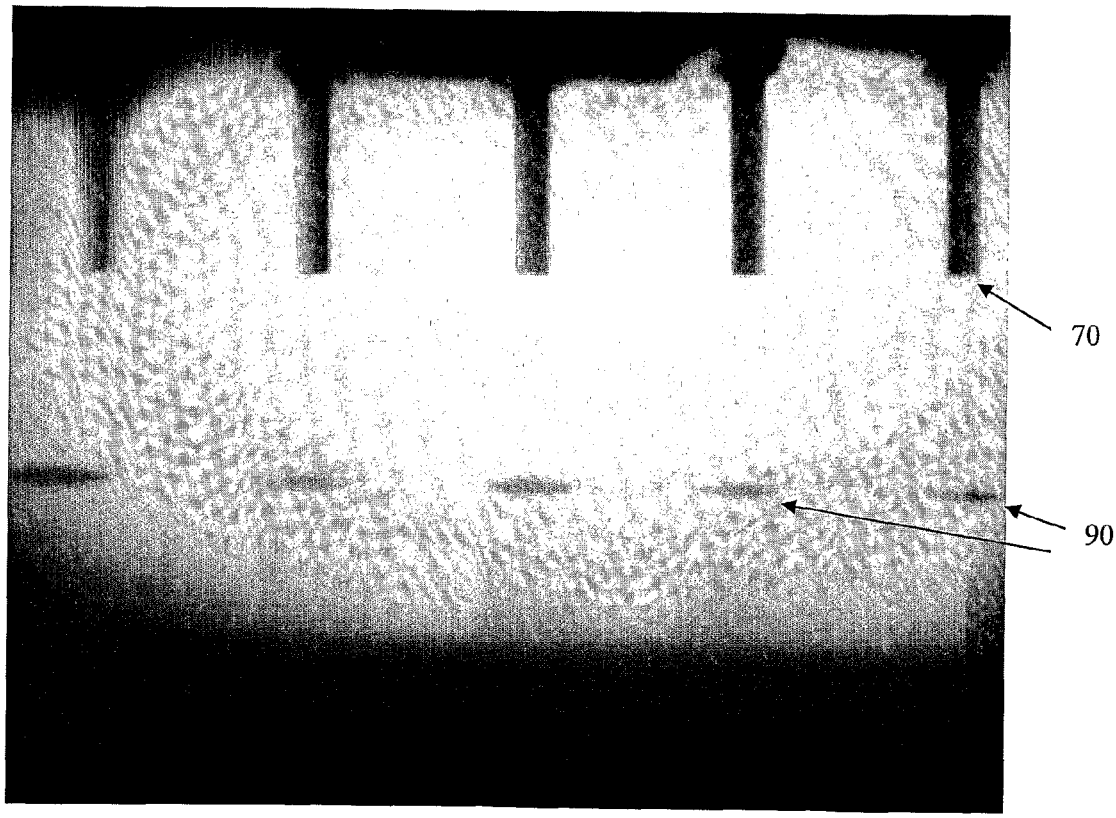
Figure 8B

Figure 9A
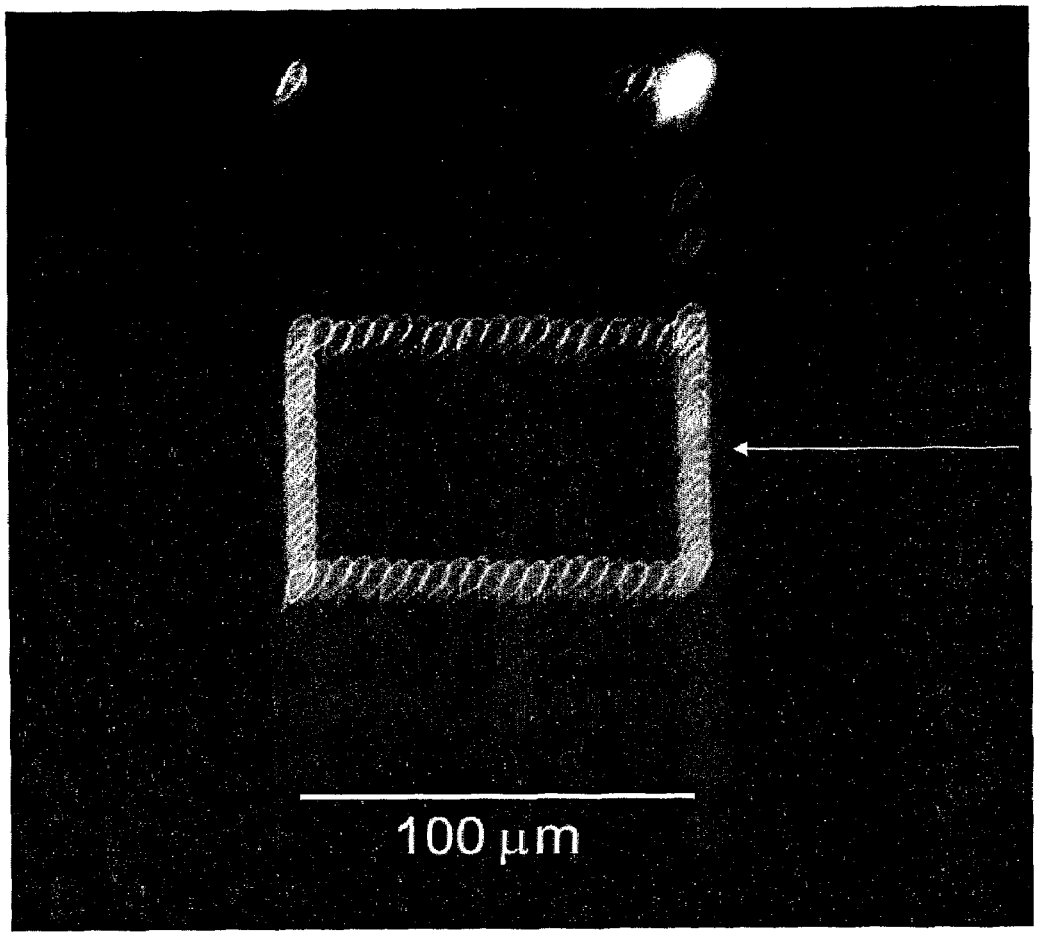
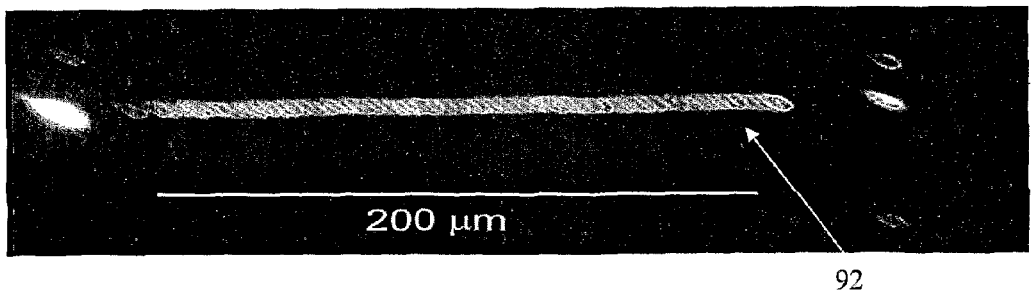
Figure 9B

94

94

ELECTROSPRAY DEVICE AND A METHOD OF ELECTROSPRAYING

The present invention relates to an electrospray apparatus and a method of electrospraying.

Electrospray is a known method of producing a spray, and electrospray ionisation has become a standard way of providing ions in a mass spectrometer. As described in Int. J. Mass Spectrom. Ion Processes 1994, 136, 167-180, the sensitivity of such devices has been increased by using glass capillaries drawn to 1-2 μm exit diameter. This can produce a continuous stream of droplets in the 100 nm diameter range from flow rates of approximately 20 nl per minute and higher. Such devices are known as nanoelectrospray ion sources.

A characteristic of nanoelectrospray is that the flow rate can be dictated by the voltage applied and the tube geometry, in particular the exit diameter. This has the advantage that electrospray can be achieved without the use of pumps or valves to force the liquid from a reservoir to the exit. The disadvantage is that control and measurement of the flow rate is difficult. The flow rate of an electrospray affects the size and charge of droplets, and their size distribution.

Electrospray occurs when the electrostatic force on the surface of the liquid overcomes the surface tension. The most stable electrospray is that corresponding to a cone-jet, in which the balance between electrostatic stresses and surface tension creates a Taylor cone, from the apex of which a liquid jet is emitted. A stable cone-jet mode requires a minimum flow rate. Creation of a stable cone-jet also requires the applied voltage to be within a particular range. When the voltage and/or flow rate are below that required for a stable cone jet then other spray regimes occur, including dripping, electrodripping and spindle mode.

It is known from Mass Spectrom. Rev. 2002, 21, 148-162 that when the voltage is lower than that required for the stable cone-jet mode, the liquid meniscus may undergo oscillations between a quasi-stable cone-jet and a deformed drop. This results in pulses of electrospray. The production of pulses required a constant fluid flow rate, provided by a pump.

The above known electrospray has the disadvantage that in order to start and stop the electrospray, it is necessary to start and stop the pump. It is not possible to accurately control the starting and stopping of the pump. In such an apparatus, even if the electric field is switched off the pump will continue to pump liquid into the tube, resulting in dripping. This means that fine control of the electrospray is not possible.

The present invention provides an electrospray apparatus for dispensing a controlled volume of liquid in pulses at a constant frequency, the apparatus comprising an emitter having a spray area from which liquid can be sprayed, a means for applying an electric field to liquid in, on or adjacent to the emitter, whereby, in use, liquid is drawn to the spray area by electrostatic forces and electrospray occurs in pulses at a constant frequency whilst the electric field is applied.

The apparatus has the advantage that the electrospray apparatus provides reliable pulses of electrospray which can be accurately started and stopped.

The present invention will now be described further. In the following passages different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

Preferably, the apparatus does not include a mechanical pump or any other means for pressurising the liquid.

Preferably, the emitter comprises a cavity for receiving liquid, and the spray area is an aperture in fluid communication with the cavity.

Thus, the cavity can store liquid for electrospraying.

Preferably, the emitter is a tube.

Preferably, the emitter is a surface having raised points, and the spray area is located on one or more of the raised points.

Thus, electrospray can be achieved without the use of separate tubes.

Preferably, the means for applying an electric field comprises at least two electrodes and a voltage power source connected to the electrodes, wherein at least one electrode is spaced apart from and aligned with the spray area, and at least one electrode is engageable with the liquid.

Preferably, a reservoir for containing liquid, the reservoir connected to the cavity by a passageway.

Preferably, flow of liquid to the emitter from the reservoir is monitored by a flow measuring device, preferably, the device measuring the pressure drop between a pair of spaced apart pressure sensors.

Preferably, the aperture has a diameter of between 0.1 and 500 μm.

Preferably, the aperture has a diameter of between 0.1 and 50 μm.

Preferably, a substrate is provided spaced from the spray area, such that the sprayed liquid is deposited on a surface of the substrate, thereby forming a feature thereon.

Preferably, comprising means for providing relative movement between the substrate and the spray area.

Thus, a pattern of liquid can be built up.

Preferably, the distance between the substrate and the spray area can be varied such that the size of the features formed on the substrate may be varied.

Preferably, the relative movement between the substrate and the spray area is in a plane parallel to a plane of the substrate.

Preferably, the substrate is coated with a pre-assembled monolayer of particles or molecules, and/or the substrate is coated with a pre-assembled sub-monolayer of particles or molecules.

Preferably, the substrate is an insulator, or a semiconductor or a conductor.

Preferably, the liquid contains a surface modifying material capable of altering the wetting properties of the substrate.

Preferably, the substrate surface is porous or nonporous.

Preferably, the volume of liquid ejected by a single pulse is between 0.1 femtoliter and 1 femtoliter, or between 1 femtoliter and 1 picoliter, or between 1 picoliter and 100 picoliters.

Preferably, the total volume of liquid deposited by the successive ejection of multiple pulses is between 0.1 femtoliter and 0.1 picoliter, or between 0.1 picoliter and 1 nanoliter, or between 1 nanoliter and 1 microliter.

Preferably, electrospray occurs at a frequency of between 1 kHz and 10 kHz, or between 1 Hz and 100 Hz, or between 10 kHz and 100 kHz, or between 100 Hz and 1000 Hz or between 100 kHz and 1 MHz.

Preferably, the spray area is located within a second fluid that is immiscible or partially miscible with the liquid to be electrosprayed.

Preferably, the second fluid is static or is a flowing phase.

Preferably, the spray area is located in a housing, the housing containing any gaseous environment including, but not limited to, air, elevated pressure gas, vacuum, carbon dioxide, argon or nitrogen.

Preferably, comprising a plurality of emitters, each emitter having a means for applying an electric field to liquid adjacent the spray area.

Preferably, the emitters are arranged in an array.

Thus, a pattern can be built up more quickly by using a plurality of emitters in an array.

Preferably, the means for applying an electric field is operable to independently control the electric field at each spray area.

Preferably, comprising a fast switch connected to the means for applying an electric field such that voltage is turned off or on by the fast switch to precisely control the time for which the electrospray apparatus ejects liquid.

The present invention provides a method of electrospraying comprising providing an emitter for receiving liquid, the emitter having a spray area from which liquid can be sprayed, applying an electric field of a selected strength to the liquid, whereby liquid is drawn to the spray area by electrostatic forces, and wherein the electric field strength, liquid viscosity and conductivity and emitter geometry are selected causing electrospray to occur in pulses at a constant frequency whilst the electric field is applied.

Preferably, liquid is drawn to the spray area by electrostatic forces without use of a mechanical pump or other means for pressurising the liquid.

Preferably, the emitter comprises a cavity for receiving liquid, and the spray area is an aperture in fluid communication with the cavity.

Preferably, the emitter is a tube.

Preferably, the emitter is a surface having raised points, and the spray area is located on one or more of the raised points.

Preferably, a plurality of emitters is provided, and the electric field applied to each emitter is independently controlled.

Preferably, a substrate is provided spaced from the spray area, the substrate receiving the sprayed liquid such that a feature is formed on the substrate.

Preferably, the liquid contains a surface modifying material capable of altering the wetting properties of the substrate.

Preferably, after the feature is formed on the substrate, fluid evaporates from the feature to allow the surface-modifying material to alter the wetting properties of the substrate surface at the location of the feature.

Preferably, there is relative movement between the substrate and the spray area in a plane parallel to a plane of the substrate.

Thus, a pattern of liquid can be built up.

Preferably, there is relative movement between the substrate and the spray area such that the distance between the substrate and the spray area is varied.

Thus, the diameter of droplets deposited on the substrate can be varied.

An embodiment of the present invention will now be described with reference to the figures, in which:

FIG. 8A is a side elevation view of an array of emitter tubes according to the present invention;

FIG. 8B is a side elevation view of an array of emitter tubes and substrate according to the present invention;

FIG. 9A is a plan view of a substrate after receiving electrospray according to the present invention;

FIG. 9B is a plan view of a further substrate after receiving electrospray according to the present invention;

Figure 1:
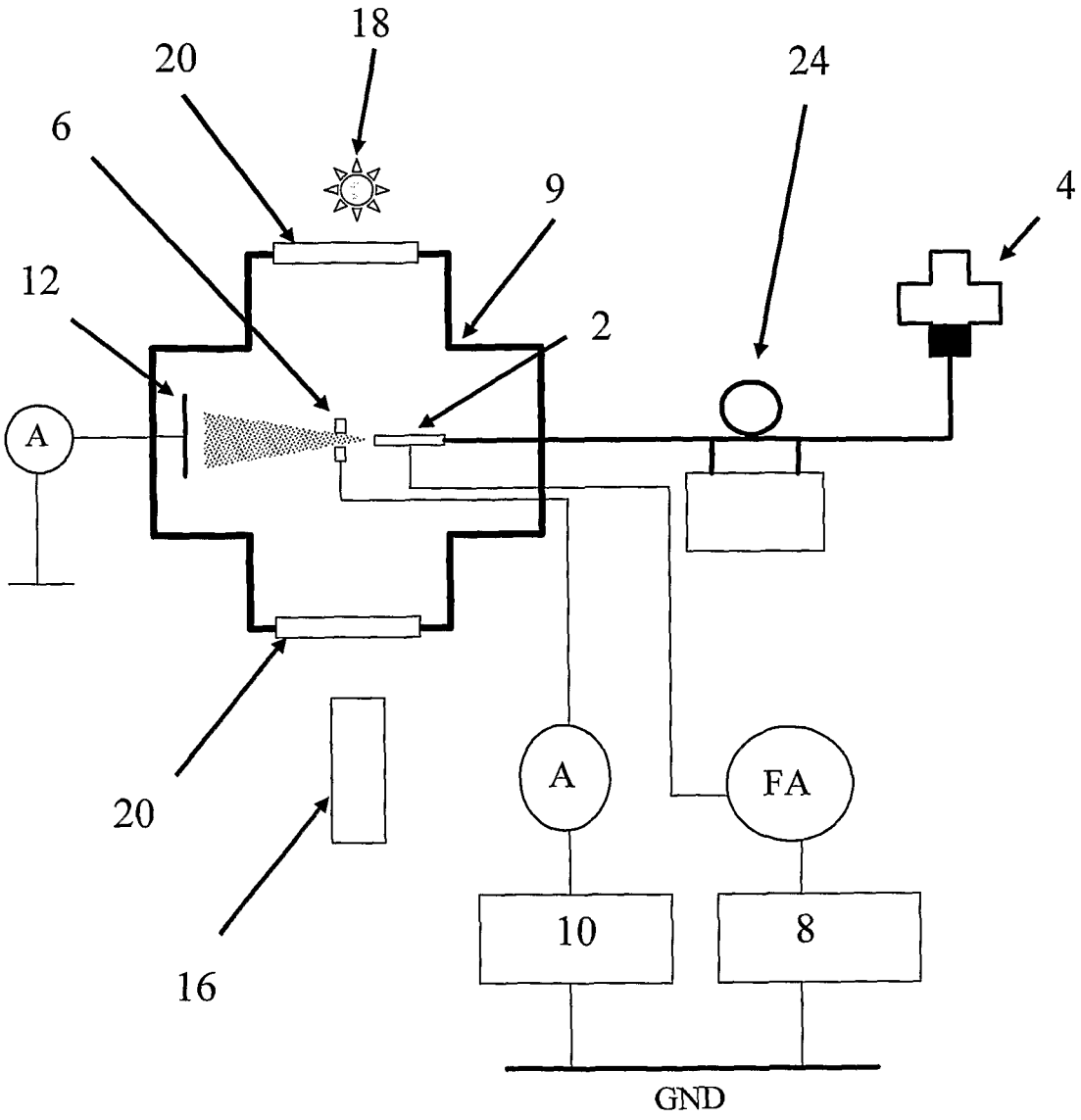
FIG. 1 is schematic view of the apparatus according to the present invention.

FIG. 1 shows an electrospray apparatus 1 according to the present invention. A capillary emitter tube 2 is in fluid communication with a fluid reservoir 4. The reservoir 4 and emitter tube 2 hold a liquid to be electrosprayed. The emitter tube 2 has a circular aperture or opening from which liquid can be sprayed.

An extractor electrode 6 is positioned approximately 3 to 4 mm from the opening of the emitter tube 2. The extractor electrode 6 has a central circular aperture, of diameter 6 mm, aligned with a longitudinal axis of the emitter tube 2. A high voltage power supply 10. of either polarity, is connected to the extractor electrode 6. The high voltage power supply 10 provides a constant voltage to the liquid. The voltage provided can be varied to a selected value.

A collector electrode 12 is aligned with the longitudinal axis of the emitter tube 2 and extractor electrode 6. The collector electrode 12 is located such that the extractor electrode 6 is between the collector electrode 12 and the emitter tube 2. The collector electrode 12 is grounded.

The emitter tube 2, extractor electrode 6 and collector 12 may be housed in a grounded stainless steel vacuum chamber 9 to allow the pressure of surrounding gas to be varied.

The electrospray may be observed by a high speed charge coupled device (CCD) camera 16, illuminated by a cold light source 18. The CCD camera 16 and cold light source 18 are located outside of the vacuum chamber 9, and operate through windows 20 in the vacuum chamber 9.

The electrospray may be measured by a current monitoring device 8 connected to the emitter tube 2, in order to measure the current through the liquid. Electrical contact to the liquid may be achieved by a surface metallic coating (not shown) on the emitter tube 2. Alternatively the electrical contact may be made directly to the liquid via a metallic electrode in contact with the liquid in the reservoir.

A suitable flow measuring device 24 may be provided to measure fluid flow from the reservoir 4 to the emitter tube 2. For example, the flow measurement device 24 may operate by measuring the pressure drop between two points by means of quartz crystal pressure transducers.

The electrospray apparatus 1 is an unforced system, meaning that there is no pump or valve connected between the aperture and the liquid reservoir when the apparatus is in use. The liquid is drawn through the tube from the reservoir only by electrostatic forces. The electrostatic forces are generated by the high voltage power supply 10.

In order for pulsed electrospray to occur, liquid viscosity and conductivity, and emitter geometry are selected so that the forces required to pull the liquid at a flowrate close to the minimum stable electrospray flowrate are not too large. The electric field strength is also selected based on liquid viscosity and conductivity, and emitter geometry. The electric field strength is chosen such that electrospray occurs in pulses, without a constant corona discharge. For a specific emitter aperture diameter, or hydraulic resistance, properties of the liquid are chosen so that for a large liquid viscosity the liquid conductivity may be higher. For a lower liquid viscosity, a lower conductivity may be used. For a smaller emitter aperture diameter, or larger hydraulic resistance, then either conductivity should be higher for a particular viscosity, or the viscosity should be lower for a particular conductivity. These relationships are applicable to all of the described embodiments.

Many different liquids can be used in the electrospray apparatus 1. Room temperature conductivities may range from 5 S/m down to $10^{-6}$ S/m but liquid metals may also be used which possess much higher conductivity. Viscosities from $1\times10^{-4}$ to $2\times10^{-1}$ Pa·s may be used.

The electrospray apparatus 1 may be used in a mass spectrometer, in order to deliver charged analytes. The very low rate of flow is of particular advantage when only a very small quantity of analyte is available. The electrospray apparatus 1 may also be used as a printer, in order to spray inks or print onto chips or substrates.

The electrospray apparatus 1 has the particular advantages that the starting and stopping of the pulses can be very accurately controlled. This is because liquid is only emitted from the tube 2 when an electric field is applied. The starting and the stopping of the electric field can be very accurately controlled.

The discrete pulses of the electrospray are produced whilst a constant, i.e. non-pulsed, electric field is applied. The amount of liquid in each sprayed pulse is independent of the time for which the electric field is applied. The constant electric field can be switched on and off to control when the discrete pulses should be emitted, and whilst the electric field is switched on the apparatus 1 emits a series of electrospray pulses. The switching on and off of the electric field does not itself directly cause the pulses. The apparatus is configured such that when a constant electric field is applied it is in a mode which automatically generates pulses. The pulses of electrospray are formed independently of any mechanical controlling means or electric field control means. This provides very consistent and uniform pulses of electrospray.

The electrospray apparatus 1 additionally has the advantage that each electrospray pulse occurs as a discrete jet, each jet containing a small and predictable volume of liquid. If there is relative movement between the tube and a surface being sprayed, then the surface will receive a series of discrete dots, which may be spaced from one another. The provision of series of dots may be advantageous for printing or other applications. This is preferably achieved by movement of the surface being sprayed, but may also be achieved by movement of the emitter.

The electrospray apparatus may generate a pulsed electric field. Each pulse of electric field may contain one or more pulses of electrospray. The electrospray pulse will generally not start at the start of the electric field pulse, and will generally not finish when the electric field pulse finishes. The pulses of electrospray are independent of the pulse length of the applied electric field. The volume emitted by the electrospray pulse or pulses will therefore depend on the number of electrospray pulses occurring in the electric field pulse, and are not directly related to the length of the electric field pulse. This allows a tolerance in the length of the electric field pulse, without affecting the quantity of liquid emitted in the electrospray pulse.

For example, if it is wished to repeatedly electrospray a volume equal to one electrospray pulse volume, the electric field can be turned on in pulses. Whilst the electric field is on, electrospray can occur in pulses at pre-determined frequency but will generally not start immediately, i.e. the device will not automatically spray as soon as the electric field is turned on. The on time for each pulse of electric field must be long enough to allow one electrospray pulse to be emitted but short enough to prevent two electrospray pulses being emitted. When the electric field is not on, the electrode and/or substrate can be moved, in order to apply sequential electrospray pulses to a different location on the substrate.

Figure 6A:
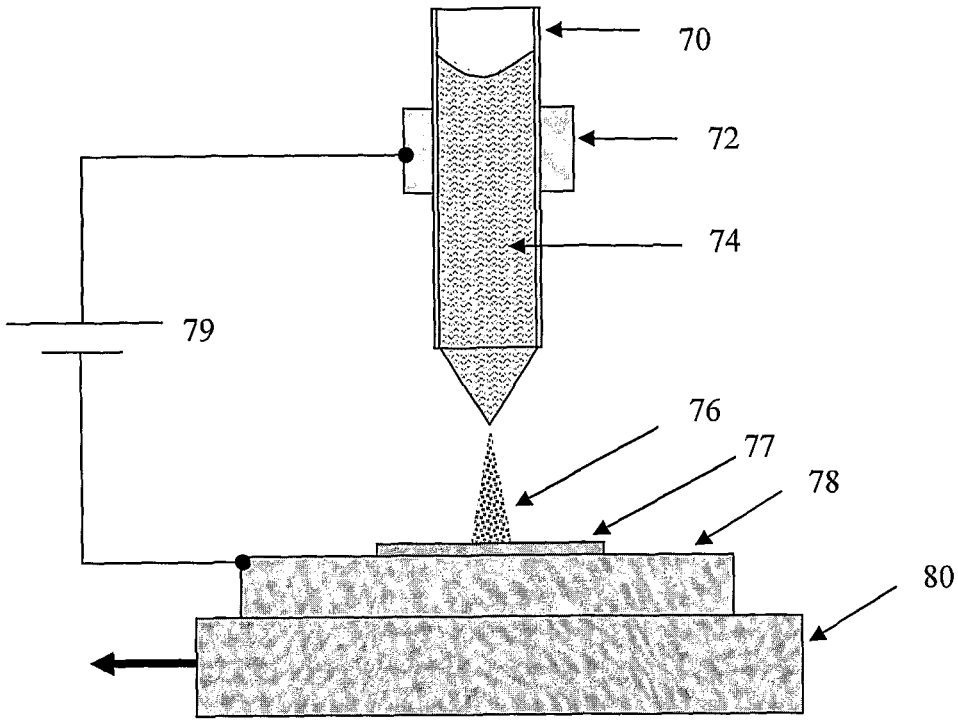
FIG. 6A is schematic side elevation view of an apparatus according to a second embodiment of the present invention.

FIG. 6A shows a second embodiment of the electrospray apparatus of the present invention. A capillary emitter tube 70 contains liquid 74 to be sprayed.

A high voltage power supply 79 is connected between an extractor electrode 78 and the emitter tube 70. An electric potential may be applied to the conductive surface of the emitter 70 by a conducting fitting 72. The high voltage power supply 79 provides a potential difference between the electrode 78 and the emitter 70.

The extractor electrode 78 is held at an appropriate distance from the emitter tip. On a side surface of the electrode 78 facing the emitter tube 70 a target substrate 77 can be placed.

The substrate may be coated with a pre-assembled monolayer of particles or molecules, and/or is coated with a pre-assembled sub-monolayer of particles or molecules. The substrate may be an insulator, a semiconductor, or a conductor.

In use, an electric potential is generated by the supply 79, such that liquid is ejected from the tube 70 as a spray 76 in pulses. The spray 76 impacts on substrate 77. A computerised high precision translation stage 80 supports the substrate 77 and electrode 78, and can move the electrode 78 perpendicularly to the direction of the spray 76.

This system is simpler than the embodiment of FIG. 1 because it does not have a reservoir separate from the emitter tube. The tube itself stores the liquid to be sprayed. This embodiment allows the deposition of the liquid onto the substrate 77 by the correct application of potential from the supply 79.

The distance between substrate 77 and emitter 70 can be varied to make the deposition area smaller or larger. The spray 76 spreads out as it travels away from the emitter 70, and so a larger distance between the substrate 77 and emitter 70 provides a larger deposition area. The electrode 78 and/or substrate 77 are preferably placed on a translation stage 80, which may be computer controlled. The translation stage 80 provides relative movement between the electrode 78 and/or substrate 77 and the spray 76 in order that the spray 76 is deposited over a selected area of the substrate 77.

Figure 6B:
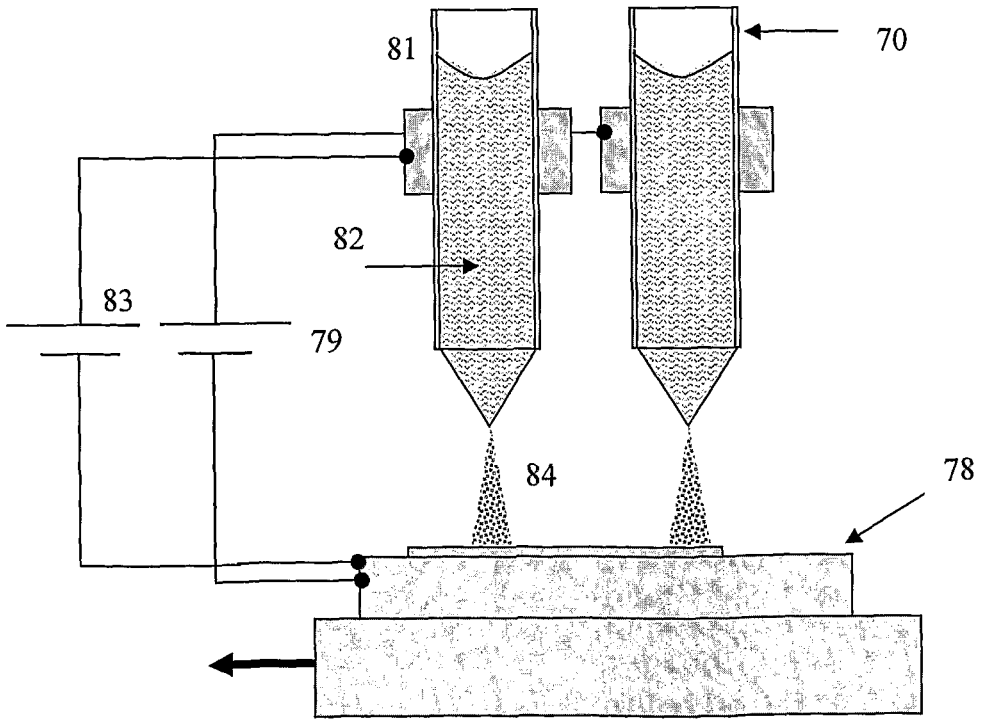
FIG. 6B is a schematic side elevation view of an apparatus according to a third embodiment of the present invention.

FIG. 6B shows a modification of the embodiment of the electrospray apparatus of the present invention shown in FIG. 6A. The embodiment of FIG. 6A comprises two emitters 81, 70. but any number of emitters may be used. The second emitter 81 contains a second liquid 82 to be sprayed. A second power supply 83 is connected between an electrode 78 and the emitter 81. The remaining features of FIG. 6B are as described for FIG. 6A. When a potential is applied to second emitter tube 81, a second pulsed electrospray 84 is produced.

Alternatively, a single power supply can be connected to both tubes 70, 81. FIG. 6B shows two emitter tubes, however more than two tubes can be used together. The tubes may be arranged in a two-dimensional array.

An array of ten emitter tubes is shown in FIG. 8A. The emitter tubes 70 are 200 μm in length, and spaced approximately 200 μm apart. The diameter of the emitter tube 70 is 30 μm. These emitter tubes can be microfabricated in silicon and silicon oxide using a Deep Reactive Ion Etch process. Such emitter tubes can be made to independently electrospray according to the present invention by placing a circular electrode adjacent the open end of each emitter tube. By independently placing a voltage onto each electrode, each adjacent emitter tube can be made to electrospray.

FIG. 8B shows some of the emitter tubes of FIG. 8A which has sprayed tri-ethylene glycol 90 on to a silicon surface.

Figure 6C:
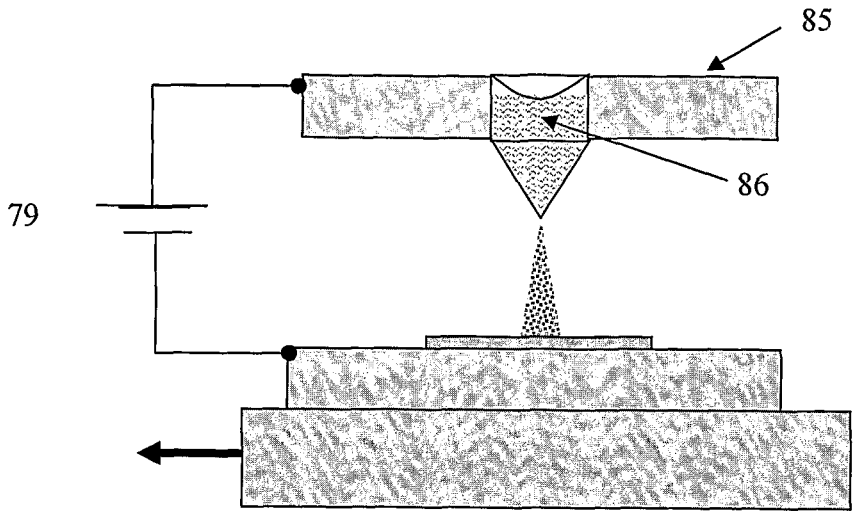
FIG. 6C is a schematic side elevation view of an apparatus according to a fourth embodiment of the present invention.

FIG. 6C shows a modification of the embodiment of the electrospray apparatus for the present invention shown in FIG. 6A or FIG. 6B. In FIG. 6C, the emitter is not in the form of a capillary tube, but is formed from any material 85 that can define a reservoir to store a liquid 86. An orifice is formed in the reservoir, from which the liquid may be electrosprayed. This embodiment may be microfabricated. A high voltage power supply 79 is connected to the material 85. The embodiment of FIG. 6C functions in the same manner as FIGS. 6A and 6B.

Any of the embodiments described above may have at least the emitter and substrate located in a vacuum chamber, from which air is substantially evacuated.

Figure 6D:
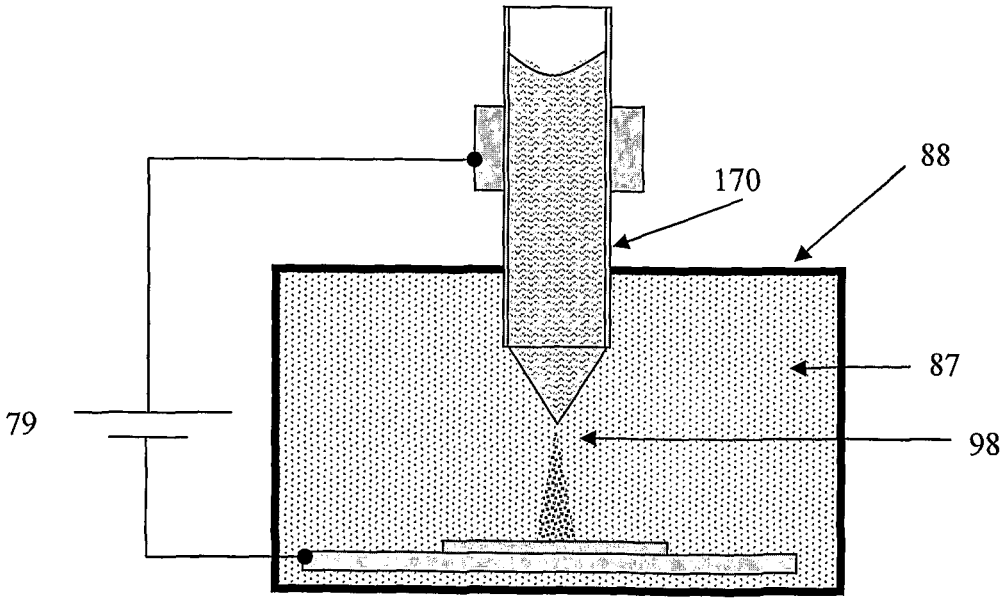
FIG. 6D is a schematic side elevation view of an apparatus according to a fifth embodiment of the present invention.

FIG. 6D shows a modification of the embodiment of the electrospray apparatus for the present invention shown in FIG. 6A or FIG. 6B or FIG. 6C wherein the emitter(s) 170 is at least partially located within a second fluid 87. The second fluid 87 is different to the electrosprayed liquid. An orifice 98 of the emitter 170 is within the second fluid 87. The second fluid 87 may be either a liquid or a gas, and is contained within a container 88. The container 88 may be sealed or connected to a reservoir of fluid 87.

The second fluid 87 is preferably immiscible with the fluid to be electrosprayed, but may be partially miscible with the fluid to be electrosprayed. The second fluid 87 may be static or flow.

Electrospraying through the second fluid allows drops of the electrosprayed liquid to be dispersed controllably in the second fluid. This allows the formation of an emulsion, for example an oil/water emulsion. It may also provide for the formation of particles having the electrosprayed liquid contained within a solidified shell of a the second liquid. Additionally, a volatile liquid may be electrosprayed in an involatile second liquid.

EXAMPLE 1

With reference to FIG. 1, the emitter tube 2 is formed of stainless steel with an opening of 50 μm diameter. The tube has a circular cross-section of uniform diameter.

The electrospray apparatus 1 was used with Triethylene glycol (TEG) as the liquid. The TEG was doped with 25 g/L NaI.

Figure 4:
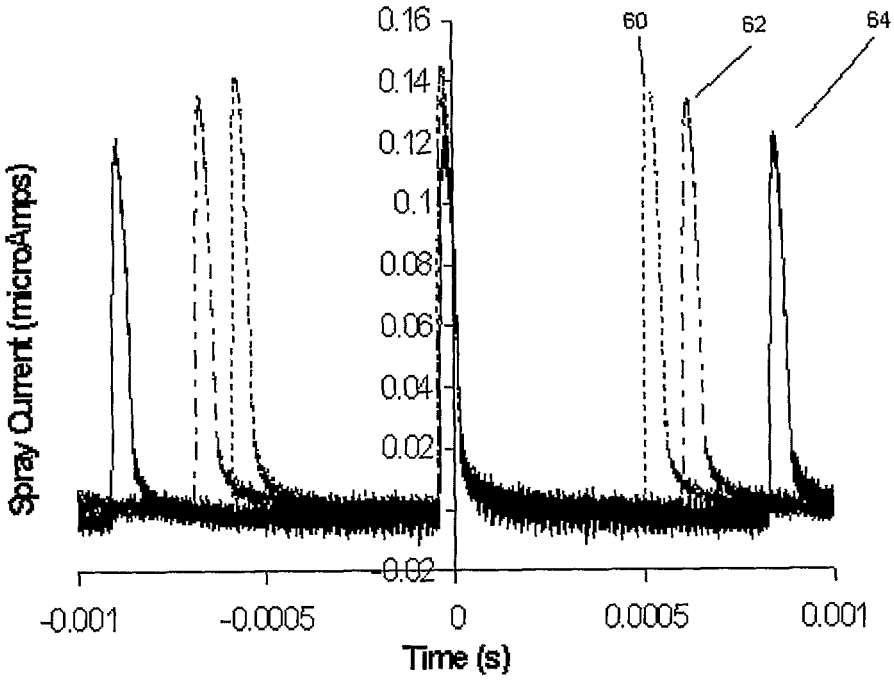
FIG. 4 shows a graph of electrospray pulses using a second liquid.

With reference to FIG. 4, oscillations in the electrospray current are shown by line 60 when a DC voltage of 2.4 kV was applied by the power supply, line 62 at a voltage of 2.2 kV and line 64 at a voltage of 2.0 kV. The oscillations were stable and have a frequency in the low kilohertz range. The frequency was lower than that observed for water as the spray liquid. These occurred between a voltage of 2.0 kV and 2.9 kV. Above this threshold a steady spray current was measured, indicating a stable continuous cone-jet spray.

FIG. 4 appears to show that peak pulse current increases with voltage in the pulsation spray mode. On further examination, it was found that at voltages above 2.5 kV, the peak pulse current decreases with increasing voltage. The pulsation frequency continues to increase as voltage is increased over the pulsation regime.

The duration of a single pulse, defined as the time the pulse current is above 25% of the peak current level, was found to be around 50 μs. The charge emitted during each pulse remained largely independent of voltage, ranging between 6 to $8\times10^{-12}$ C.

The relationship between applied voltage and flow rate of the liquid was found to be linear. The sensitivity was found to be 0.39 nL/s per kV. The time averaged flow rate at 2.0 kV was 0.25 nL/s. However, the flow rate calculated during a pulse was estimated to be an order of magnitude higher at 4.62 nL/s. This means that a volume of ~230 femtoliters is ejected with each pulse.

The size of droplets in the spray was found to be around 0.4 μm, falling to around 0.26 μm as voltage increased up to the threshold of a continuous electrospray mode.

Figure 5:
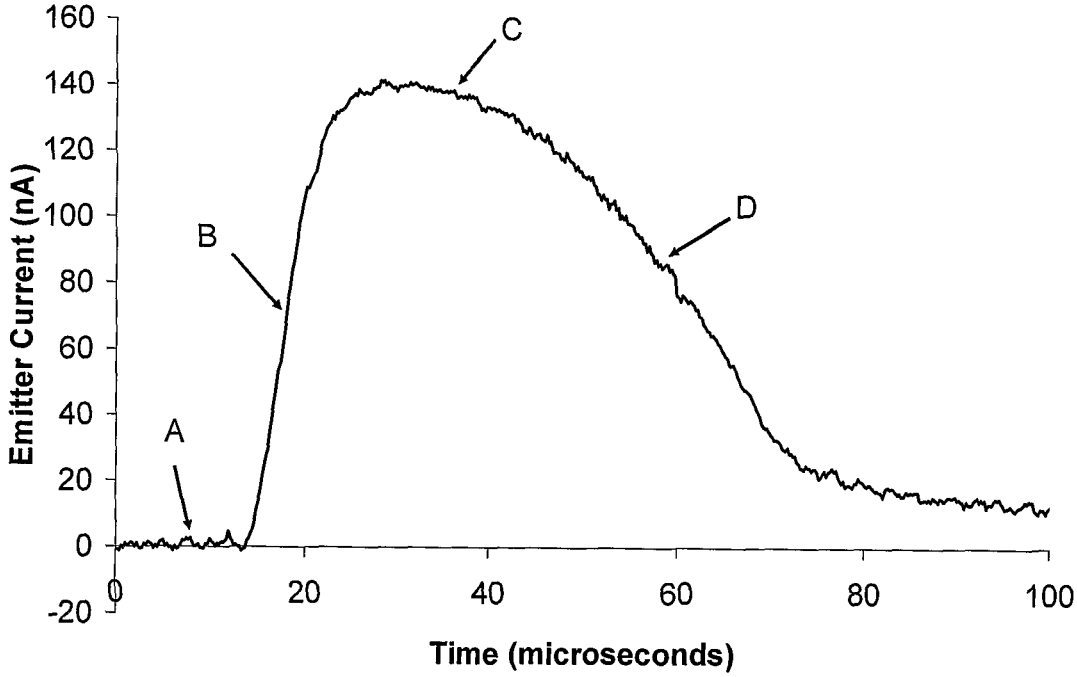
FIG. 5 shows a graph of current over a pulse of electrospray.

The formation and collapse of a cone-jet structure at a tip of the emitter tube 2 will now be described, with reference to FIG. 5. Initially, fluid accumulates at the tip and no jet is present. This corresponds to no detected current and no electrospray, and is shown in region A. The meniscus of the fluid extends into a cone shape and a jet was detected after approximately 15 μs. This corresponds to a sharp rise in detected current, illustrated in region B. A liquid jet was seen for approximately 40-45 μs, indicating that continuous quasi-stable cone-jet emission is occurring during the high current period of each pulse, shown by region C. The jet then collapses, shown in FIG. D as a rapid fall in measured current.

EXAMPLE 2

An example of the electrospray apparatus 1 using distilled water as the liquid to be sprayed will now be described. The emitter tube 2 was formed of silica with a 50 μm interior diameter, tapering to an opening of 10 or 15 μm diameter.

A distilled water solution containing NaI was prepared, having a conductivity of approximately 0.007 S/m. The aperture has a diameter of 10 μm, and was formed of silica.

Figure 2:
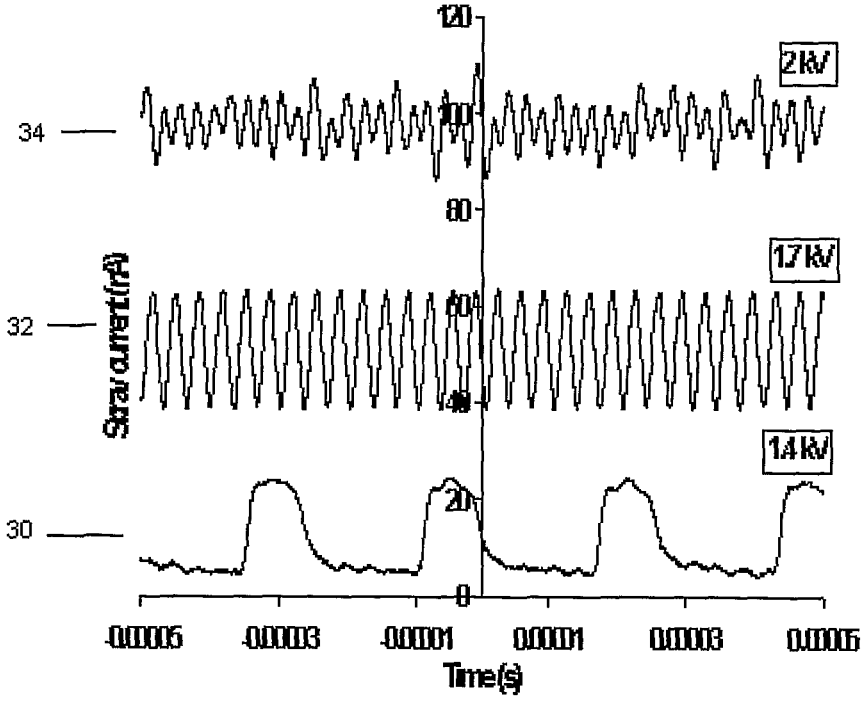
FIG. 2 shows results obtained from the present invention.

With reference to FIG. 2, a continuous, constant DC voltage was applied to the extractor electrode, and electrospray charge emission observed as a constant frequency current oscillation of the spray liquid. This was found to be in the low kilohertz range. This current oscillation is shown as line 30, and occurred between voltages of 1.3 kV and 1.4 kV. Line 30 is an example shown at 1.4 kV. This indicates that the apparatus 1 is producing a pulsed electrospray at a constant frequency. Each pulse of electrospray dispenses a volume of liquid in the order of a femtoliter. At a voltage of below 1.3 kV no electrospray occurred, for pulsing electrosprays using a pump or pressure head (such as described in Int. J. Mass Spectrom. 1998, 177, 1-15) other forms of fluid discharge such as dripping will occur when the voltage is insufficient.

At a voltage between 1.5 kV and 1.9 kV a slightly different type of oscillation occurs, shown as line 32. The oscillation frequency has jumped by an order of magnitude from line 30, and the minimum spray current is higher than the peak current observed for line 30. The camera revealed the presence of a faint jet emerging from the liquid meniscus. This indicates that the apparatus 1 is still producing a pulsed electrospray at a determinable frequency.

At a voltage of above 1.9 kV a transition to a chaotic flipping jet regime was observed, shown as line 34. Line 34 was recorded at 2.0 kV. Line 34 does not have a definable frequency, and the camera revealed an unstable jet faintly oscillating between two off-axis positions.

Figure 3:
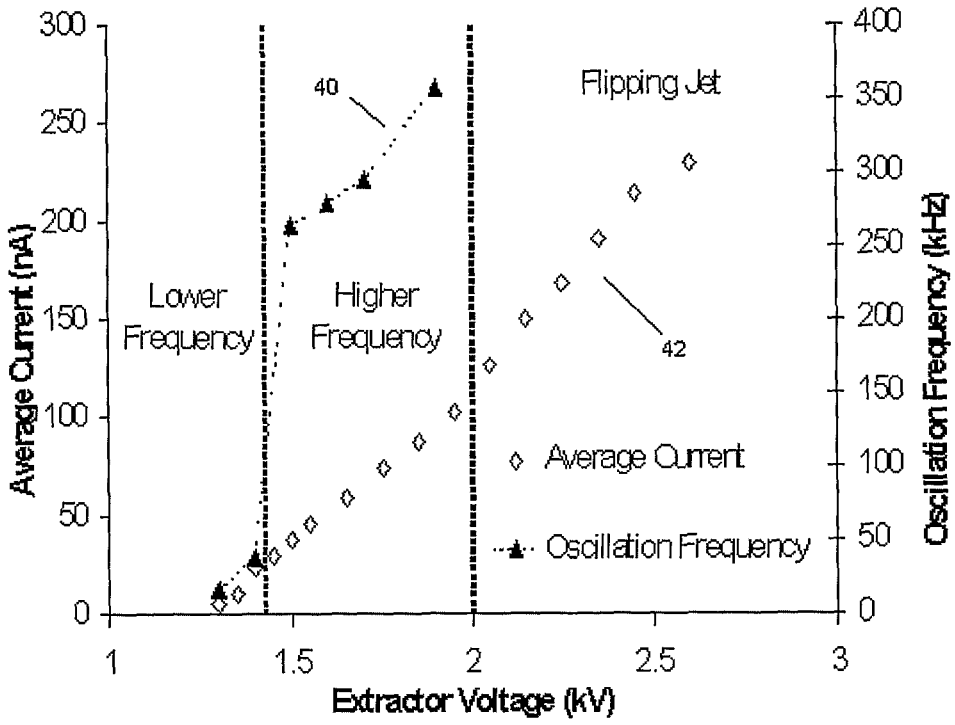
FIG. 3 shows a graph of various modes of an electrospray apparatus using a first liquid.

With reference to FIG. 3, the relationship between average current in the liquid with extractor electrode voltage is shown as line 42. The average current is shown to increase with increasing voltage over the range. The relationship between current frequency and extractor electrode voltage is shown as line 40. Line 40 shows a distinct difference in frequency between a lower frequency at a voltage below 1.5 kV, and a higher frequency between 1.5 kV and 2 kV.

The oscillatory nature of the electrospray up to a voltage of 2 kV provides a reliable, very low volume flow rate electrospray.

EXAMPLE 3

The emitter tube 70 is formed of borosilicate glass pulled to a 4 μm diameter.

The electrospray apparatus 2 was used with Triethylene glycol (TEG) as the liquid. The TEG was doped with 25 g/L NaI.

With reference to FIG. 6A. the substrate 77 was a polished single crystal silicon and was held on an aluminium electrode 78 approximately 50 μm away from the tip of emitter 70. The electrode 78 was placed on a computerised high precision translation stage 80 that could move the electrode 78 to the right. Potential differences of between 600V and 900V were applied by the supply 79.

Figure 7:
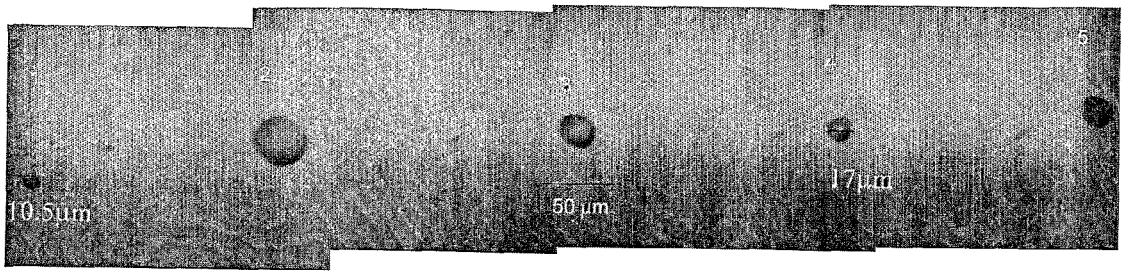
FIG. 7 shows a micrograph of sub-picoliter volumes of fluid dispensed by the present invention.

FIG. 7 shows microscopy images of the liquid deposited onto the surface as a result of leaving the pulsing electrospray over one point for approximately 1-5 secs, before moving it to the side by a few hundred μm using the stage 80. The longer the electrospray was left over the substrate the larger the volume of liquid deposited. The diameters of the hemispherical drops ranged from approximately 10 μm to approximately 50 μm. These liquid drops have volumes between approximately 200 femtoliters and 20 picoliters.

EXAMPLE 4

An example of the electrospray apparatus 1 using the room temperature ionic liquid 1-ethyl-3-methyl imidazolium tetrafluoroborate ($EMIBF_4$) as the liquid to be sprayed will now be described. The emitter tube 2 was a stainless steel tube with 50 μm tip diameter.

A pure $EMIBF_4$ solution, having a conductivity of approximately 1.3 S/m and viscosity of $43\times10^{-2}$ Pa·s was used. With reference to FIG. 1, a continuous, constant DC voltage was applied to the extractor electrode, and electrospray charge emission observed as a constant frequency current oscillation of the spray liquid. This was found to vary from hundreds of hertz to the low kilohertz range. Each pulse of electrospray dispenses a volume of liquid in the order of a femtoliter.

EXAMPLE 5

The electrospray apparatus was used to electrospray a fluorescently labelled protein (Albumin). The protein was in water with a small amount of ammonium acetate buffer. A 4 μm emitter tube diameter was used, spraying onto a silicon substrate.

FIGS. 9A and 9B show the results of the electrospray. Each drop contained approximately 15 femtoliters in. The drops overlapped to form lines having a minimum line width of around 7 to 8 μm.

These results were obtained when the electric field was pulsed on and off. Whilst the electric field was pulsed on, a single electrospray pulse was emitted. Whilst the electric field was off, the substrate was moved relative to the electrospray electrode. In FIG. 9A, the substrate moved in a rectangular manner, forming a rectangle of protein. In FIG. 9B, the substrate was moved in one direction, forming a line of protein. The water in each drop evaporated before the subsequent drop was deposited.

EXAMPLE 6

Figures 10A, 10B:
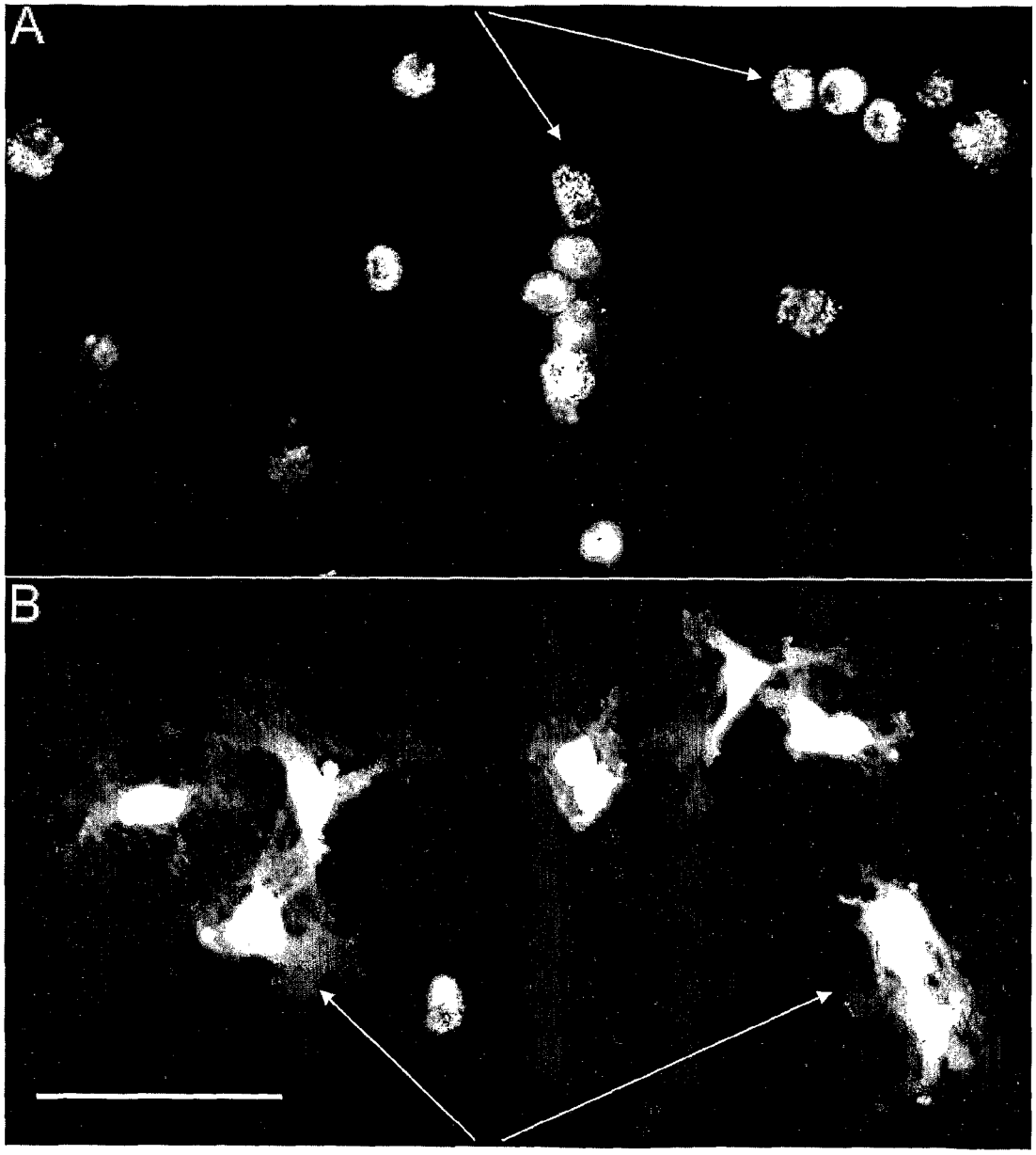
FIG. 10A is a plan view of a further substrate after having received electrospray according to the present invention.
FIG. 10B is a plan view of a yet further substrate after having received electrospray according to the present invention.

The electrospray apparatus can also deposit proteins in water, such as fibronectin, that can modify the surface properties of a material. FIGS. 10A and 10B show results of this, using a 4 μm emitter tube. In FIG. 10A, the substrate was a simple silicon surface and no fibronectin has been deposited on the surface. Cells 94 which are then placed on the surface (by conventional means) are shown not to proliferate, and so there is a low viability for these cells. In FIG. 10B, parallel horizontal lines of fibronectin, an adhesive protein (not shown), was deposited on the substrate surface in 5 μm wide lines spaced approximately 30 μm apart (not shown). FIG. 10B shows that conventionally placed cells 94 adhered well to the surface and proliferated. The scale bar in FIG. 10B is 100 μm long.

EXAMPLE 7

The electrospray apparatus 1 was used with a conductive silver ink. The ink has a viscosity of 5000 mPa·s, and is 40% by weight of silver nanoparticles. The emitter tube had a diameter of 2 to 300 μm. When placed approximately 500 μm from the substrate, and a substrate moved relative to the emitter tube, a line of width of approximately 200 μm was formed. A thinner line could be achieved by using a lower diameter emitter tube at a distance closer to the substrate.

The electrospray apparatus 1 may find applications in place of conventional electrospray devices. In particular, they may be used in polymer electronics to create displays, or in rapid prototyping in place of a thermojet. They may be used in manufacturing, for positioning adhesives, patterning or making electronic components. The electrospray device may be used for painting or printing, or micropipetting. It may also find applications in microbiology, such as deposition of femtoliter or above volumes of liquids containing valuable proteins, peptides, ribosomes, enzymes, RNA, DNA or other biomolecules that can be put into solution. The apparatus may be used as a drop on demand dispenser of fluid.

The liquid that is electrosprayed may be aqueous or nonaqueous. The liquid may contain a biomolecule, for example, selected from the group consisting of DNA, RNA, antisense oligonucleotides, peptides, proteins, ribosomes, and enzyme cofactors or be a pharmaceutical agent. The liquid may contains a dye, which may be fluorescent and/or chemiluminescent. The liquid may contain a surface modifying material capable of altering the wetting properties of the substrate surface. The liquid may be evaporated to allow the surface modifying material to alter the wetting properties of the substrate.

The nonaqueous fluid may comprise an organic material, for example, selected from the group consisting of hydrocarbons, halocarbons, hydrohalocarbons, haloethers, hydrohaloethers, silicones, halosilicones, and hydrohalosilicones. The organic material may be lipidic, for example selected from the group consisting of fatty acids, fatty acid esters, fatty alcohols, glycolipids, oils, and waxes.

A nonaqueous liquid to be electrosprayed may comprise Polyacrylic acid, or polymer ionomers. The liquid may contain inorganic nanoparticles.

The liquid to be sprayed may contain conducting polymers or electroluminescent polymers. The conducting polymer may contain poly(3,4-ethylenedioxythiopene) or poly(p-phenelyne vinylene). The liquid may contain Poly(D,L-lactide-co-glycolide), or be or contain an adhesive, or contain a gelation agent.

The electrospray apparatus may be used with other liquids than those described above, and with different sized openings of emitter tube. The above description provides information to allow a person skilled in the art to select the appropriate voltage to apply to the tube to generate pulses of electrospray.

The electrospray typically occurs at a frequency of above 1 kHz. The frequency of electrospray may alternatively be between 1 kHz and 10 kHz, or between 1 Hz and 100 Hz, or between 10 kHz and 100 kHz, or between 100 Hz and 1000 Hz or between 100 kHz and 1 MHz or span across any number of these ranges The volume of liquid ejected by a single pulse may be between 0.1 femtoliter and 1 femtoliter, or between 1 femtoliter and 1 picoliter, or between 1 picoliter and 100 picoliters. The total volume of liquid deposited by the successive ejection of multiple pulses may be between 0.1 femtoliter and 0.1 picoliter, or between 0.1 picoliter and 1 nanoliter, or between 1 nanoliter and 1 microliter, or may be greater.

Pulses of electrospray may occur when a voltage is applied to the electrode of preferably between 0.5 kV and 4 kV, or preferably between 1 kV and 3 kV, or preferably between 2 kV and 2.5 kV, or preferably at approximately 2 kV.

The emitter has been described in some embodiments as a tube. Alternatively, a different shape may be used. The emitter may be of any shape, and have an aperture from which the liquid is sprayable. The emitter may store liquid and/or be connectable to a reservoir of liquid. The aperture of the emitter may have a diameter of between 0.1 and 500 μm, and preferably between 0.1 and 50 μm.

Alternatively, electrospray may occur from a roughened surface. A surface may be formed having sharp pyramid-like points. An electrospray may be generated on the tip of the pyramid. The surface may be formed of silicon and may have any rough or pointed form. Such an electrospray is known as externally wetted electrospray.

A particular geometry of electrode has been described. Other arrangements of electrodes designed for the purpose of ion manipulation by electrostatic fields may alternatively be used.

The apparatus has been described as an unforced system, without a means to pressurise the liquid. Alternatively, the apparatus may comprises a pump or other means to pressurise the liquid to be electrosprayed.

Further examples and embodiments of the present invention will now be described in relation to further work undertaken by the inventors. This is provided by way of example only and serves to improve an understanding of the possible mechanisms underlying the present invention.

EXAMPLE 8

1-2 General

Unforced nanoelectrospray can exhibit a number of stable spray modes. These include low frequency pulsations, high frequency pulsations, and a steady cone-jet. Experiments are reported here on such pulsations that have been observed in various salt loaded solutions of ethylene glycol, triethylene glycol and water. The spray current was monitored with 1 μs time resolution to show that spray regime characteristics depend on nozzle diameter and liquid conductivity. The frequency of pulsations was found to increase with both increased liquid conductivity and decreasing nozzle diameter. The charge ejected during a pulse is lower for smaller nozzles spraying higher conductivity liquids. Water solutions were observed undergoing high frequency pulsations, with these pulsations often occurring in lower frequency bursts. The frequencies of water pulsations were as high as 635 kHz but the charge ejected by each pulsation was an order of magnitude lower than that observed in triethylene glycol. An unforced electrospray of water was also identified as being in the steady cone-jet mode with a higher degree of confidence than previously. The values for stable pulsation frequency and charge ejected observed in ethylene glycol lay between those of TEG and water.

In ESI-MS applications, nanoelectrospray is typically performed using so called "offline analysis" tips. In general these tips are made from capillaries with inner diameters of 500 μm or more that reduce to a tip diameter of 1-4 μm. The sample is loaded using a fine pipette into the body of the needle.

The majority of the emitters used for the experiments reported here are similar to those used in ESI-MS; they are silica capillaries, however with a 75 μm ID pulled to an exit diameter of either 8 μm, 15 μm or 30 μm (New objective, MA). The outer diameter of these at the emitter tip is approximately the same as the internal diameter due to the taper used. The 75 μm bore tips cannot be filled via pipettes. Instead, nitrogen was used to pressure feed the liquid from a 100 μL plastic sample vial into the tip. This was performed by connecting the spray capillaries to a feeding capillary of ~50 cm length and 180 μm ID using a stainless steel union (Valco). The union was of the zero-dead-volume type to minimise the possibility of deformable gas bubbles in the liquid connection. The feed capillary was fed into the sample vial via a Swagelok tee-piece using a vepel ferrule to connect to the feed capillary and a rubber o-ring to connect to the sample vial. Liquid was loaded into the sample vial by syringe before fastening the o-ring fitting. The feed capillary exit was submerged in the sample liquid. The tee-piece allowed $N_2$ gas pressure to be applied to the sample vial from a regulator and measured using a digital manometer.

The liquid union was held in an insulator and the ground wiring connected the union to the fast current sensing equipment. This approach results in the liquid meniscus being held at the ground potential via the conductivity of the liquid, rather than via a metallic coating at the tip exit. This reduces the occurrence of corona discharge, a potential problem particularly whilst spraying water.

The high voltage required to start the spray was applied to a polished aluminium disc held 3 mm away from the emitter on a separate insulator. The height of the electrode could be adjusted by micrometer. The majority of the emitter assembly was shielded by a grounded metal cylinder in order to reduce noise.

The spray equipment was initialised by the application of gas pressure that forced the liquid into and through the spray tip. The application of a high potential difference meant the flowing liquid did not gather on the tip exit but was sprayed away from the tip. After any obvious bubbles were flushed through this back pressure was removed and after a few minutes the voltage switched off. The liquid was then held (by surface tension) at the exit of the tip. The fluid surface in the liquid vial was held at the same height as the liquid tip exit to ensure that there was no net hydrostatic pressure acting on the liquid membrane. The electrospray current on the emitter was amplified from the nanoampere range using a variable gain high-speed current amplifier (Laser Instruments, UK—model DHCPA-100) at a gain of $10^6$V/A at 1.6 MHz bandwidth. This signal was measured by a digital storage oscilloscope (Wavetek, wavesurfer 422) through 50Ω DC coupling at 20 MHz bandwidth. All data was captured from a single scan with no averaging. Independent measurements of the average current at the extractor electrode were obtained on-line using a non-grounded multimeter. High voltage was applied to the collector to allow us to ground the emitter through the fast current amplifier. This allowed the monitoring of the emitted current rather than the collected current with high temporal accuracy.

A high-resolution microscope monitored the shape of the liquid meniscus and determined the spray regime. The microscope consists of a Mitatoyu 10× infinity corrected objective on a Thales Optem 12.5× variable zoom, coupled with a Sony V500 CCD camera. The resolution of this video microscope was ~2 μm.

In each of data sets, for a given nominal tip diameter, two different emitters were used. Whilst it would be expected that the measured spray properties should be consistent within the band of measurement uncertainty, it was found that such measurements seemed to lie outside the measurement errors. We believe that this is due to the detailed variation in the emitters as supplied, particularly in the internal emitter profile, since the data we are taking is expected to be dependent on the internal and external properties of the emitters. As a result we have plotted the values determined for frequency, peak currents, etc, for both sets of emitter.

Ethylene glycol (EG), tri-ethylene glycol (TEG) and distilled water, were used as base solvents. To be stable in nano-electrospray mode at a flowrate of order 1 nL/min, a solution must have conductivity greater than Ca. $10^{-2}$ S/m. Pure solvents must therefore be doped with an ionic compound. In the present work, EG, TEG and distilled water solutions containing varying concentrations of NaI were prepared. To avoid contamination of the EG and TEG solutions with water vapour these solutions were prepared in a dry box. Conductivity was determined using a novel triangular waveform method.

All electrospray experiments were performed with no net pressure applied to the fluid to force fluid flow. The majority of our attention here is on the mode previously identified as a variant on the forced flow mode, termed Axial mode II. These results are reported in sections 3.1 to 3.3. However other modes were also observed and these are reported in section 3.4 and 3.5.

The experimental method, followed for all the solutions, was as follows. The voltage on the extractor was increased from zero until steady oscillations were observed; this voltage is $U_o$, the onset voltage of oscillations. For many nozzles, this point was preceded by the sporadic appearance of current spikes with no discernable frequency. Corona discharge did not occur at such low voltages. These spikes were neglected. At each of the measurements taken above $U_0$, the current trace was stored and an image taken of the meniscus, using the video microscope, in order to identify any distinctive features. The period of the oscillations and time averaged collector current were recorded. Corona discharge was ruled out by observing those sprays obtained at high electrical field using long CCD exposure times.

3.1 General Pulsation Characteristics

Typical current waveforms obtained for TEG solution T25 sprayed from a 15 μm diameter tip. The legend indicates the voltage at which the trace was obtained. Only a few waveforms are shown to preserve clarity. The traces show that as the voltage increases the current peaks associated with the oscillations become closer. The data presented in these curves also shows, in this case, that the maximum current, $I_{peak}$ also becomes larger, as the voltage is increased.

The time-averaged current measured with the multi-meter, $I_{ave}$, increases in a near linear fashion with voltage throughout the pulsation regime. As the electrospray mode transforms into the steady state cone jet regime, there was a noticeable increase in this average current. During the cone-jet mode the average current then continues to increase linearly with voltage.

In the majority (85%) of the tests undertaken with TEG solutions, the pulsation regime switched to a steady state operation of stable cone-jet mode. At a certain threshold voltage the current pulses changed to a steady current having a lower value than the maximum pulse peak currents. No oscillations could be observed in this state. Observation of the liquid meniscus revealed the cone apex and jet (the latter only visible for lower conductivities) to be non-fluctuating.

Water is a common solvent for many electrospray applications however, its properties differ considerably from tri-ethylene glycol, in particular its surface tension is much higher and viscosity is much lower. Pulsations of the same form as those observed in TEG solutions, pulsation mode axial II were also observed. A comparison between the raw pulse data reveals that in water the pulse durations are more than an order of magnitude shorter than for the TEG solutions; thus in water pulse durations are typically of ~2 μs, in comparison to TEG pulses lasting ~50 μs. The shorter pulse duration is also associated with a much higher frequency pulsations.

The way the frequency of pulsations in water changes with the applied voltage has another feature which distinguishes it from TEG. Thus in water there is a clear step from a low frequency albeit at 50 kHz to a very high frequency 200 kHz pulsation mode. Whilst this rapid frequency rise was shown in our previous work, for the tip used in that work no cone-jet mode was obtained. In two thirds of the water solutions tested in this work a transition from pulsation to a stable cone-jet does take place under VMES control. Of those combinations which entered a cone-jet mode 75% sustained the mode over a wide voltage range.

Ethylene glycol is similar to TEG in many respects, although its viscosity is ~50% lower. A smaller number of experiments were performed using two EG solutions, whose conductivity values span an order of magnitude difference. Fluid properties for these solutions are also identified in Table 1. The general characteristics of EG pulsations are similar to those observed in TEG, with there being no high frequency transition.

3.2 Axial Mode II Pulsation Dependence Upon Applied Voltage

A greater range of results was obtained using the solvent TEG. This was because this solvent has the lowest surface tension of the three liquids and as a result onset occurs at lower voltage for a given tip size. The lower voltage in turn reduces the risk of corona discharge.

Figure 11:
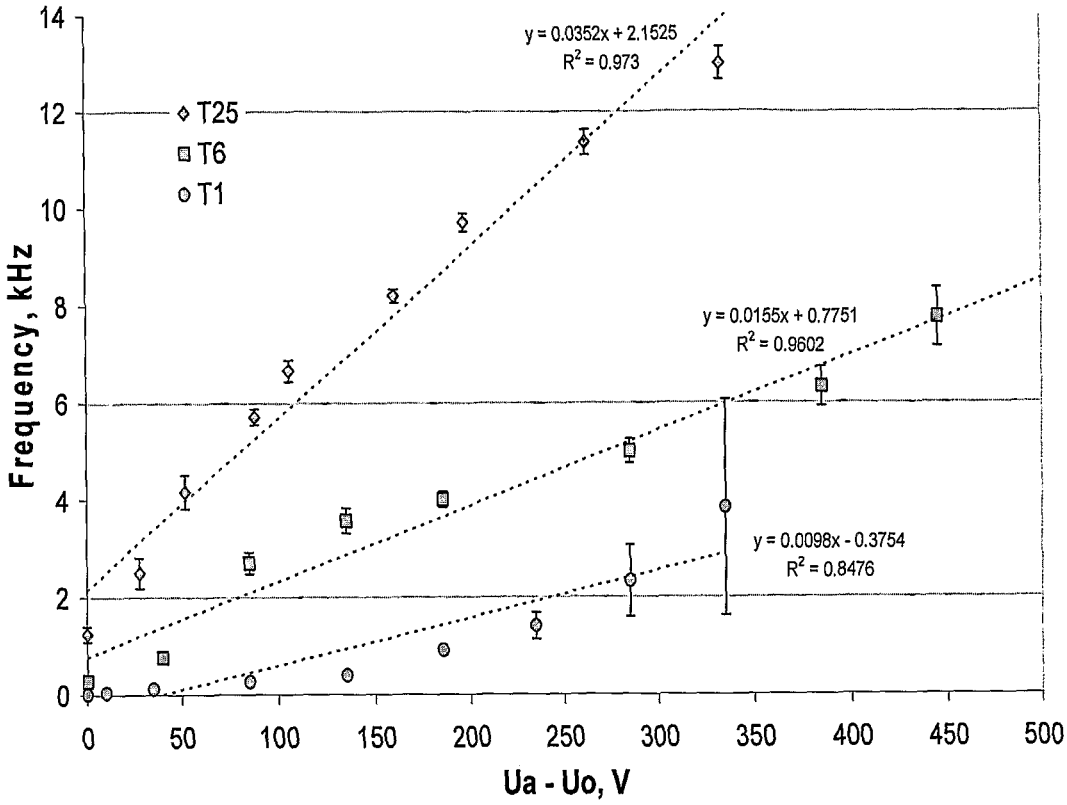
FIG. 11 is a graph showing the relationship between Oscillation frequency against voltage excess for T1, T6 and T25 on 15 μm emitters.

Investigation of the effect of conductivity on the observed pulsation properties was examined by electrospraying the liquids T1, T6 and T25. This range of liquids provides a variation in conductivity over more than an order of magnitude. The onset voltage for stable pulsations was identified to be a function of the liquid/emitter combination. As a result, in order to compare results, rather than using the applied voltage $U_a$ it is more physically insightful to plot measured parameters as a function of voltage above this onset voltage, $U_a$-$U_o$. We define this to be the voltage excess. The dependence of pulsation frequency, as a function of voltage excess for each solution, is shown in FIG. 11. In each of the data sets the emitter used was one having an exit diameter of 15 μm. Error bars are included to reflect the fact that the period of the oscillations has some slight variation. This fluctuation is more noticeable at voltages close to $U_o$ and in low conductivity solutions. The regular increase of pulsation frequency with voltage excess as shown indicates that throughout the voltage range the pulsation mode is indeed Axial II.

The frequency of the stable spray oscillation varies over more than an order of magnitude for these three solutions. The increase in frequency appears to be linear with the applied voltage. Comparison of the gradients for the best fit linear trend for these data sets $\Delta f/\Delta(U_a-U_o)$, in the different liquids also shows that as the fluid conductivity increases, there is a corresponding increase in the rate with which the pulsation frequency increases with applied voltage. Indeed for this overall data set, albeit comprising of only 3 gradient values, there appears to be a good correspondence between best fit of the gradient value $\Delta f/\Delta(U_a-U_o)$ versus conductivity K, with there being a linear trend, with a regression coefficient of 0.98. As a result we conclude that the frequency of the pulsations obtained for a specific tip is higher for a higher conductivity liquid.

Investigation of the sensitivity of the peak current during a pulse upon the applied voltage was also undertaken. Some fluctuation in the value of the peak current, $I_{peak}$ was observed in the pulsations at a fixed value of voltage excess. As a result, in order to get a measure for this important parameter the value of $I_{peak}$ for typically up to 10 pulses were used. The values so obtained are plotted in FIG. 4, wherein the measurement fluctuation is indicated by the plotted error bars. These data were obtained from 15 μm diameter tips. From this data the voltage dependence of the magnitude of $I_{peak}$ observed is rather unclear. Thus in the highest conductivity liquid tested (T25) there appears to be a linearly increasing trend in current with voltage excess; the regression coefficient for this data is 0.991. The gradient of current with voltage is however modest, and the total range of peak current for this liquid varies by less than 25% of the mean value The lower conductivity solutions show no discernable trend with applied voltage.

We conclude that the sensitivity of peak current to voltage is weak for the TEG solutions tested, implying that the maximum rate that charge is removed during the pulsation is rather insensitive to the applied field.

As with the TEG data, both the water and EG experiments showed that decreasing the liquid conductivity results in lower peak currents. For the specific case of water the W70 solution had peak currents typically only 25% of those achieved with W7000. The dependence of $I_{peak}$ both in water and EG with applied voltage again has a similar characteristic to those described for TEG, wherein sensitivity was more notable in the higher conductivity solutions. This suggests that $I_{peak}$ does indeed increase with applied voltage, however the quality of the data at present is insufficient to resolve fully the nature of the dependence.

3.3 Axial Mode II Pulsation Dependence on Tip Diameter

Experimental data was also obtained to identify how the tip diameter affects the properties of the observed pulsations. The properties of interest are the pulsation frequency, the peak current and the total charge extracted during a pulse. As we have seen from the preceding section the pulsation characteristics for each liquid are dependent upon both the applied voltage and the solution conductivity. In order therefore to make comparisons between data sets it is necessary to identify specific conditions for these comparisons.

Figure 12:
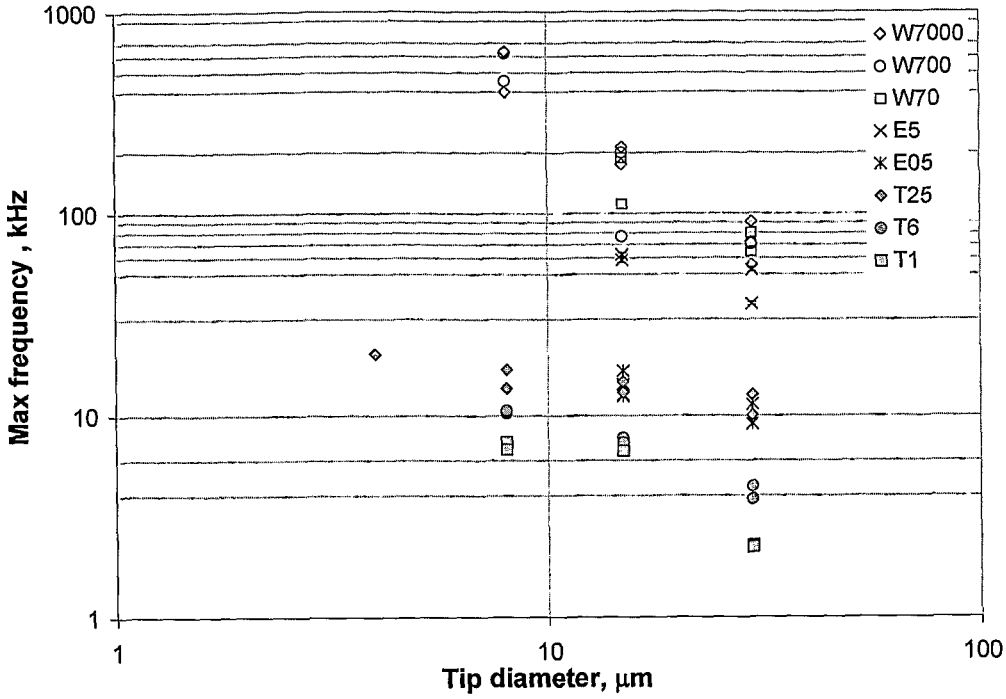
FIG. 12 is plot of the effect of liquid conductivity and tip diameter on the average peak current during a pulse

All liquids investigated demonstrated that the highest frequency of pulsations was always obtained at a voltage excess just below that at which the pulsation mode was replaced by some other spray regime. In many cases, including data obtained for water, this would be a transition to stable cone-jet mode. In certain examples, such as those taken on the largest emitter tip size, the spray mode could change to either a multi-jet mode or even a corona discharge. As a result, when making detailed comparison between liquids we have selected the maximum frequency, $f_{max}$ as an appropriate way to capture frequency dependence. This data is collected for all the solutions in FIG. 12, for each tip/liquid combination.

The overall data for the three TEG solutions shows that $f_{max}$ increases with both increasing conductivity and decreasing tip diameter over the complete range of liquids and tip size. These two trends for each solvent are also evident within the water and EG data sets. It is also apparent that the highest frequency oscillations are obtained from high conductivity water solutions sprayed from the smaller diameter tips. The highest frequency pulsation observed was 0.63 MHz. We note that water is the lowest viscosity solvent tested, and that there is a general trend through the data sets that higher frequency pulsations are observed for lower viscosity solutions.

We have already noted that for the highest conductivity TEG solution tested, the peak current shows some sensitivity to the applied voltage applied from one particular tip. However we have concluded from the data presented in FIG. 4, that overall this sensitivity is modest. As a result, but noting this as an approximation, we characterize here the peak current during a pulsation, for each solution, by the average value of $I_{peak}$ observed over the entire voltage range for which stable Axial mode II pulsations occur. This average value $\langle I_{peak}\rangle$, as a function of tip diameter, is plotted in FIG. 6 for the TEG data. These data show a significant correspondence of $\langle I_{peak}\rangle$ with both liquid conductivity and tip diameter. Thus on a given tip, as the conductivity of the solution increases, there is an increase in $\langle I_{peak}\rangle$. Additionally as the tip size increases, for a given solution the value of $\langle I_{peak}\rangle$ also increases.

In water, as with the TEG, the effect of reducing the tip diameter was again to lower the peak current during a pulse. The average peak currents when spraying w7000 were 172 nA, 73 nA and 53 nA for 30 μm, 15 μm and 8 μm tips respectively.

There are two issues now to consider in relation to the combination of frequency sensitivity data and current sensitivity data. The peak current identifies the maximum charge extraction rate from the fluid meniscus, whereas the total charge extracted from the meniscus, that is the integral of current through the pulse, gives an indication of the amount of material which may be removed from the meniscus during the pulsation, if one assumes that the charges extracted are indeed solvated. Although the peak heights of the current pulses increase with both conductivity and tip diameter the pulse duration was observed to decrease with conductivity and increase with tip diameter.

The data for all solutions tested for the pulse duration, $T_{on}$, is found. Here, the on time, $T_{on}$ has been defined as the width of the pulse peak when the current is greater than $0.25*(I_{peak}-I_{base})+I_{base}$. The longest pulse duration was 159 μs, for T1 sprayed from a 30 μm needle, whilst the shortest pulse duration for TEG was 16 μs for T25 sprayed from a 4 μm nozzle.

Let us then approximate the charge ejected during one current pulsation to be given by $I_{peak}*T_{on}$. This approach has been validated by comparing this value against that obtained for specific measured waveforms by numerically integrating the pulse shape itself. This comparison revealed that there is good agreement between the two methods to within typically 10%. The calculated charge ejected during a pulsation for the solutions is found against tip diameter. We reemphasize that we have used the average value of $I_{peak}$ for these calculated values and data is therefore an averaged pulse charge over the full voltage range over which stable pulsation occurs. The data plotted reveals a strong trend wherein the charge ejected during a pulse increases with the diameter of the tip.

In almost every case the charge ejected from a tip spraying water solutions is an order of magnitude lower than for the same sized tip spraying TEG solutions. This trend is also visible in the EG solutions, with the charge emitted during a pulse being more comparable to the TEG solutions. It is interesting to note that the EG data falls between that for TEG and that for water.

Although the data demonstrates some scatter, herein we have only plotted error bars for the noisiest data set in order to maintain clarity, the charge ejected, for a given solvent, appears to be independent of conductivity. This is most clearly seen in the TEG data.

The voltage, $U_{CJ}$, at which the spray became a stable cone-jet, was dependent on the tip diameter, with no discernable influence from the liquid conductivity. The average onset voltage excess, $\Delta V_{ave}=\langle U_{CJ}-U_o\rangle$, for all data from each nozzle tip diameter were: 278V, 495V and 717V for 8 μm, 15 μm and 30 μm tips respectively. Clearly then the range over which pulsations occur is greater for a larger tip diameter. The cone-jet onset also takes place at higher voltage for larger tips. This is in accordance with the standard electrospray onset voltage model popularized by Smith.

The onset of cone-jet mode shows a correlation with the pulsation duty cycle, defined by pulse duration divided by the period $T_{period}$, associated with the pulsation frequency. The maximum duty cycle is difficult to obtain precisely as the stability of the spray frequency is reduced as stable cone-jet operation is approached. However, some simple observations can be made. The maximum duty cycle in all cases is always of the order of 40-50%. We have not seen any evidence of a pulsing VMES transitioning to a stable cone jet when the duty cycle is below 20%. Similarly, we have not observed a pulsating electrospray with a duty cycle greater than 59%. It appears that the pulsating mode is unstable if the pulse duration is very close to the time between oscillations.

The onset voltage of the pulsations, $U_o$, varied with the nozzle diameter. For TEG the average $U_o$ was 1044V, 1443V and 1753V for 8 μm, 15 μm and 30 μm diameter tips respectively. Values for EG were very similar. For water the average $U_o$ was 1423V, 1782V and 2140V for 8 μm, 15 μm and 30 μm diameter tips respectively, this reflects the higher surface tension of water.

3.4 Axial I Mode in VMES

As we have noted not all the liquids show the same pulsation nature across the range of applied voltages wherein stable pulsation modes may be observed. Thus particularly when spraying low conductivity water solutions on the larger tips, direct comparison of data is made more complex by the appearance of new pulsation modes. Two sample waveforms were obtained when spraying w70 on 30 μm tips. Both waveforms are reminiscent of the Axial I pulsations described by Juraschek and Rollgen in that there are very high frequency pulsations (~100 kHz) occurring in much lower frequency groupings (~3 kHz). However this similarity is perhaps superficial due to the following: a) Juraschek and Rollgen's findings were in forced, rather than unforced spray conditions, b) in our new data significantly higher frequencies but with a smaller number of pulses form the pulse envelope. This is the first report of Axial I pulsations during unforced nanoelectrospray or VMES. This mode of spraying was also observed in the EG solutions, but only on the largest emitter having a tip diameter of 150 μm. The E5 solution exhibited double peaks only, whilst E05 exhibited a very large number of bunches of pulsations at frequencies as low as 20 Hz. No Axial Mode I pulsations were observed in the TEG solutions however.

This mode will only occur for the appropriate combination of liquid and nozzle; the data obtained suggests a low value of hydraulic resistance is required. The low viscosity of water coupled with the larger tip diameter means that small fluctuations in pressure can result in relatively large liquid flowrates into the cone. Since the mechanism behind Axial mode I pulsation is thought to be the depletion and replenishment of the entire liquid cone, any disturbances may lead to relatively large-scale mechanical oscillations in the liquid meniscus.

3.5 The axial IIB Mode

The calculated charge lost during a pulsation in section 3.3 is based on charge being emitted only during the 'on-time'. A different measure can be obtained by integrating the current waveform over some period of time, not specifically related to any of the frequency characteristics of the data, say the data capture time and then dividing this charge by the number of pulses captured; this calculation yields the charge ejected per pulse cycle, ΔQ. This approach fully includes any charge ejected in the trailing edge of a pulse. A measure of current, termed here $I_{DC}$ may be derived from this total charge, ΔQ being divided by the pulse on time, $T_{on}$. A plot of $I_{DC}$ against voltage excess for the TEG solutions on a 30 μm tip was found.

$I_{DC}$ increases with voltage excess for these solutions until a maximum is reached. This mode was named Axial mode IIB in our previous work, however, it does not always occur. During all the experiments undertaken here, this mode seems more prevalent at higher conductivities and larger nozzle diameters. The axial IIB mode was also observed for some of the EG data, but was absent for all water solutions. Low temporal resolution images taken of the liquid meniscus suggest a possible physical mechanism for this mode, as shown in FIG. 11. A larger nozzle was used to allow the change in meniscus shape to be seen clearly.

The meniscus deformed due to electric stress, although in this condition there is no liquid ejection. The meniscus undergoes stable pulsations in either Axial mode II or IIB, although the jet is not discernable in the images.

The size of the liquid cone decreasing as the meniscus becomes stressed by the increasing electric potential. The average charge ejected increases with the size of the nozzle. In general the size of the meniscus may be presumed to be dependent on the size of the capillary tip. Thus, if we assume the dependence is on the size of the liquid meniscus, then the decrease in the charge ejected may be due to the reduction in the cone dimensions. If this is correct then the Axial mode IIB could be expected to occur only in situations where increasing the voltage causes the liquid cone to retract. This does not always occur during the pulsation regimes, although it often occurs during the stable VMES cone-jet mode and always precedes the multijet mode.

4 Discussion

Figure 13:
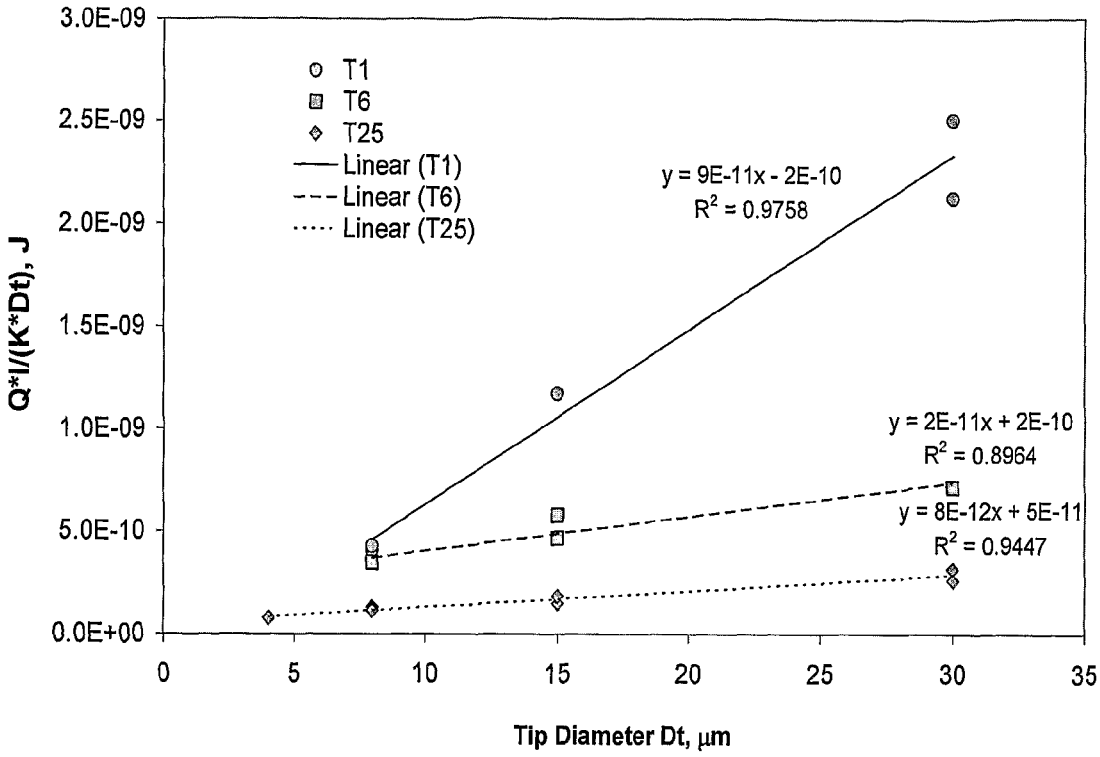
FIG. 13 is a plot of $Q_{pulse}*I_{peak}/(K*D_t)$ as a function of tip diameter $D_t$.

Many new features of stable pulsating nanoelectrospray process have been observed. Not all pulsation modes are observed in all liquids in all capillary systems, and thus we can infer that the combination of fluidic properties and geometric parameters that have been varied are such that their interaction leads to the differing observations. The results presented do however demonstrate definable characteristics. Thus it is apparent that the amount of charge released during a pulse in Axial mode II, increases as the tip diameter increases. The data also indicates that this release is dependent, for a given liquid, upon the liquid conductivity. Since the pulsation is a quasi-static process one can infer that the collapse of the apex meniscus volume arises principally due to a removal of charge from the apex more rapidly than the combined effects of surface advection and bulk conduction can supply charge to the meniscus. The rate at which charge is removed is described by the current waveform of the individual pulses as demonstrated. We have also seen how the peak current during a pulse is dependent both on the fluid conductivity and the dimensions of the capillary tip. Further, the gradients of the best-fit linear regression of the data displayed in FIG. 13, show a distinct trend with the liquid conductivity: the high conductivity liquid having a steeper gradient than the low conductivity data. These observations suggest that the combination of charge loss $Q_{pulse}$ and the ratio of peak current $I_{peak}$ to conductivity, K should also be a function of the tip diameter.

A plot of such data does indeed reveal a broad correlation between the value obtained for $Q_{pulse}*I_{peak}/K$ for a given liquid and the diameter of the tip. We may also regard this and provide a physical context for this observation from a rather different starting point. Consider the electrical power required to drive the charge flux through the cone and meniscus into the fluid jet. If the charge flux were to be dominated by bulk conduction, thus neglecting surface advection and bulk convection of charge, during a pulse the total energy required may be approximated over the pulse on-time, $T_{on}$, by $$\int^{T_{on}} I^2 R_{cone}\, dt$$

where $R_{cone}$ is an electrical resistance associated with the fluid cone. This value for $R_{cone}$ may be simply derived for a right circular cone, with base diameter $D_t$, of a solution whose conductivity is K. It is found to be $\propto 1/K*D_t$. Thus the energy required to drive the charge may be approximated to $$E_{Pulse} \propto \frac{Q_{Pulse} * I}{K * D_t}$$

Thus a potentially revealing parameter to evaluate is the value of $$\frac{Q_{Pulse} * I}{K * D_t}$$

to provide an expression of the amount of electrical energy associated with the pulsations in a given liquid. This energy value, derived from data for the three TEG solutions alone is plotted in FIG. 13.

As can be seen, there appears to be separation between the individual solutions. The data seem well characterized by a linear dependence of energy with tip diameter, wherein the gradient of the best fitting trend is a function of the solution conductivity. High conductivity solutions reveal a lower energy per pulse, and the rate at which energy increases with tip size is also lower for higher conductivity TEG. Consider now the other solutions tested. If we assume from the foregoing that conductivity influences the rate at which the pulse energy increases with tip diameter, it is most appropriate to compare solvent solutions having similar conductivity. Unfortunately, solutions with identical conductivity in different solvents are not available at this time. However two solutions having similar conductivity are the TEG solution T6 and the water solution W70. The data for pulse energy for these is collected. Again we see in the water data a similar trend of increasing energy with tip diameter.

For these two data sets presented, although of rather limited scope, it is quite clear that the higher viscosity solution has a higher energy requirement per pulse. It is interesting to note also that the gradients of the best fit trend lines have very similar values, although at this stage it would be premature to conclude that this gradient is solely dependent upon the solution conductivity.

In conclusion these results suggest that for liquids having higher viscosity more energy is required to drive the pulse, relative to those of lower viscosity, in order to extract liquid in a pulsatile jet. Additionally for a given tip diameter greater energy is required to extract a liquid having lower conductivity. These observations suggest that any model developed to capture the key features of the nanoelectrospray pulsation mode must necessarily include the defining role of bulk conduction of charge flow within the cone structure itself, as well as the role of surface advected charge in defining the shape of the meniscus itself and its deformation.

5. Summary

This work has investigated the characteristics of unforced VMES for two very similar liquids, ethylene glycol and triethylene glycol, as well as water. When spraying TEG solutions we found the frequency of the pulsations was larger for higher conductivity liquids and smaller tip diameters. The peak heights of the current pulses increased with both conductivity and tip diameter Pulse duration increases with tip diameter. We estimated the total charge ejected during a single pulse and found this to be smaller for smaller tip diameters. This may result from the charge ejected being related to the dimensions of the liquid meniscus, and so is fixed for a certain tip size for a range of conductivities. Higher conductivity liquids result in larger pulse currents so the total charge is ejected more quickly, resulting in a shorter pulse duration.

The results from the water solutions showed a trend, similar to the TEG solutions, of higher frequencies for higher conductivity and smaller tip diameters but the results were less conclusive. However the maximum frequency obtained, 635 kHz, was 31 times higher than the maximum frequency obtained for TEG. Even for liquids of similar conductivities, W700 and T6, the water frequencies are considerably higher. In contrast, the lowest charge ejected by a water solution pulsation was an order of magnitude lower than from the TEG solutions.

A new VMES mode was reported in water, which was similar to the Axial mode I described for forced flow but observed here for an unforced flow. Water solutions were sprayed in stable cone-jets in the unforced VMES mode over wide voltage ranges. This is the first report that uses the tools of fast current measurement and fast microscopy imaging to verify that the stable cone-jet mode for water solutions in unforced electrosprays is stable and free of current oscillations.

In the pulsation mode a fixed amount of charge and presumably fixed liquid volume is ejected from each pulse. It is believed that the inability of the system to replenish the liquid cone with either charge or liquid causes the pulse to stop. The electrical field then draws both charge and liquid to the apex region until the surface charge and radius of curvature is such that the electrical stress overcomes the surface tension and the jet forms. As the field increases with voltage the time taken to replenish the charge and liquid decreases and therefore the pulsation frequency increases.

The analysis of the electrical energy required to drive the pulsations suggests that bulk conduction has a role in the charge transport process. The pulsation energy is dependent on both the fluid conductivity and viscosity.

EXAMPLE 9

1-2 General

The ability to atomize a liquid sample into femtoliter droplets and deposit them precisely on a surface is a key problem in microfluidics and chemical analysis. Here we show that control of stable oscillations in an unforced electrospray is a high accuracy drop-on-demand method of depositing femtoliter droplets. Examples are presented of a liquid jet, formed for 35 μs, in a discontinuous spray mode controlled using electrostatic fields of short duration; no liquid pump was employed. Each transient jet ejects femtoliter volumes of material, which was deposited on a nearby surface. The volumes ejected by pulsating sprays on a range of nozzle sizes are predicted from electrospray scaling laws. Using the modified nanoelectrospray method, we have printed 1.4 μm wide features onto a surface in a drop-on-demand fashion with a placement accuracy of a few micrometers. We anticipate that our technique could produce biological micro-arrays and precisely deliver ultra-small samples for lab-on-a-chip analysis.

The extremely short duration of the transient jets (on the order of microseconds) in VMES mode allows much lower volumes of liquid to be ejected than with these other techniques. Further, by controlling how many ejections are allowed to occur, this mode can be used as a drop-on-demand technology of unprecedented resolution. In this paper we demonstrate this enhanced resolution by the patterning of 1-2 μm dots onto a silicon substrate. This method offers an order of magnitude decrease in feature size over existing drop-on demand direct writing technologies.

In order to visualize the deformation of the liquid meniscus a high-speed camera (Lavision, Ultraspeedstar) was used with a flashlamp for illumination. High voltage was applied to an extractor plate via a high voltage supply (F.u.G. Electronik) connected to a fast voltage switch (DEI PVX4130). The voltage monitor output was connected to a digital storage oscilloscope (Wavetek, wavesurfer 422) and could act as a trigger source for both the oscilloscope and the flashlamp. The spray needle used for visualisation was a 50 μm ID, 115 μm OD stainless steel tapertip (New Objective), this needle was filled with liquid. This rather large capillary was used simply to help facilitate optical inspection of the spray process. For all other experiments, glasstips (New Objective) were used which had 4 μm tip diameters and a metal coating; these were filled by pipette. Electrical contact was made to the glass spray needle via a conducting ferrule and the spray current was amplified from the nA range using a 1.6 MHz variable gain amplifier. The extractor electrode was fixed to a 3D translation stage, the two horizontal axes were under computer control with a resolution of 0.1 μm and a maximum speed of 1 mm/s; the vertical axis was a manual stage. For the deposition studies a 1 $cm^2$ sample of single crystal silicon was placed on the extractor electrode; it had etched positioning marks to facilitate ease of inspection and analysis of the residues.

However, we are unaware of any work using unforced electrosprays in which the peaks in the spray current are shown to coincide with the temporary existence of the liquid jet. Experiments were performed to capture synchronously the spray current and sequential high-speed camera images of the oscillating fluid meniscus during pulsating nanoelectrospray operation. For these tests, a solution of Tri-Ethylene Glycol (TEG) doped with NaI to a conductivity of 0.033 S/m was sprayed from the stainless steel needle. This solution was used because the low surface tension allows the spraying process to start using relatively low voltages. The high voltage switch was used to apply the potential of −1868 V to a metal extractor electrode for a 500 ms duration at a frequency of 1 Hz. The voltage monitor output of the fast switch acted as a trigger for the oscilloscope to start acquiring the emitted spray current, and to trigger the flashlamp and fast camera. The flash was triggered 499.5 ms after the start of the voltage pulse and the camera began to acquire 16 images with 35 μs interframe times, 100 μs after the flash trigger. In this way, the timing of the image capture can be overlaid with the emitter current waveform, the camera noise has been removed from the current trace using Fourier smoothing. The images in FIG. 2*b* show that current pulses are associated with the transient formation of the liquid jet. When the current is zero the liquid meniscus is deformed but no jet is present. This strengthens the assumption made previously that mass is only ejected during the lifetime of the jet, though we accept that other mass loss mechanisms may occur, such as the ejection of droplets with low charge, or evaporation from the surface.

3. The Volume of Liquid Ejected by a Pulse.

Data we have presented previously can be re-evaluated in order to highlight the volume of material ejected during individual pulses. This analysis was not presented in these former works, but is relevant here to the focus of the new results. There are two ways to estimate the volume ejected from a pulse. The first method requires the liquid flowrate to be measured as described above, using an in-line system that takes measurements of the flowrate at 1 Hz. These measurements identify the time-averaged flowrate over sever thousand pulsation events. If we do assume that the jet is the sole mechanism of mass loss we can state that the volume ejected during a pulse, $V_{pulse}$, is:

$$V_{pulse} = \frac{Q_{ave}}{f} \tag{1}$$

where $Q_{ave}$ is the time-averaged flowrate, and f is the pulsation frequency.

An alternative method is to estimate the flowrate during a pulsation using accepted scaling laws. For a steady-state electrospray the spray current is known to vary with flowrate according to:

$$I = f(\varepsilon)\sqrt{\frac{\gamma K Q}{\varepsilon}},$$

where γ is the surface tension of the liquid. The function, $f(\epsilon)$, depends on ϵ, the relative permittivity, and was found for liquids with conductivity, K, above $10^{-5}$ S/m. It has been argued that a transient electrospray jet may be considered steady if it exists for longer than the charge relaxation time, τ, given by $\tau=\epsilon\epsilon_o/K$, where $\epsilon_o$ is the permittivity of free space. For the TEG solution used K=0.033 S/m and ϵ=23.7 so the charge relaxation time is 6.4 ns, much shorter than the observed jet lifetime. A further requirement for application of the scaling law is that the jet diameter is much smaller than the capillary diameter; this condition is also satisfied in the observed transient jet. We can then rearrange the scaling law to estimate the flowrate from the measured current during the pulse. Although the spray current changes over the pulse duration, it may be approximated to a square wave of duration, $\tau_{on}$, with a magnitude, $I_{dc}$. This current $I_{dc}$ is derived from the charge ejected per pulse cycle divided by $\tau_{on}$, where the charge ejected is obtained by integrating the current waveform over the data capture time and then dividing this charge by the number of pulses. This allows the volume ejected during a pulse to be estimated by:

$$V_{est} = \frac{\tau_{on}\varepsilon}{\gamma K}\left(\frac{I_{dc}}{f(\varepsilon)}\right)^2 \quad (2)$$

Applying equation (1) to the data above, the volumes ejected by each pulse were found to range from 81 fL to 297 fL over the range of applied voltages. Applying equation (2) to that same data estimates the volume ejected as 89 fL to 131 fL over the voltage range. For the liquid used $\gamma$=0.04 N/m and $f(\epsilon)$=12. If the estimate from the measured flowrate is assumed the most accurate then the scaling law underestimates the volume ejected. Obtaining in-line flowrate measurements requires a complex system and may not be possible for applications where the liquid is not fed by a capillary piping system. In those cases, equation (2) may be useful as an order of magnitude prediction and requires only the capture of high-speed current waveforms.

The frequency of jet formation and fluid ejection is dependent on the electrostatic field and for TEG solutions varied from ~0.2 to 20 kHz with each ejection lasting between 12 and 160 μs on a range of nozzle sizes. For the same solution the magnitude of the pulsation current, pulse duration, and therefore the charge ejected during a pulse, all decreased with the size of the nozzle used. The results of applying the scaling law volume estimate to the data above; that data was obtained for TEG (K=0.033 S/m) sprayed from a range of nozzle sizes. The data points are the average over the voltage range and the error bars represent the variation over the range of voltages for each nozzle. The results from equation (1) are shown for comparison. The plot predicts that smaller nozzle diameters will result in pulsations ejecting smaller volumes of liquid. For a 4 μm diameter nozzle volumes of the order of 1 fL are predicted.

4. Isolating Spray Pulsations

In order to operate a pulsating nanoelectrospray source as a drop-on-demand device it was necessary to dispense a predefined number of liquid ejections in a controlled fashion. In these experiments, TEG doped with NaI to a conductivity of 0.01 S/m, was sprayed from a glass capillary with a 4 μm tip diameter. We note that the general shape of the spray current pulsation for this smaller capillary is similar to that found in the larger one, the current waveforms of all pulsations obtained from a range of TEG solutions conformed to this morphology, regardless of nozzle diameter used; as is more fully shown above. Using the fast voltage switch a potential difference of ~500 V was applied between the spray needle and the substrate electrode for 1 ms duration at a frequency of 1 Hz. The result was a pre-selected number of pulsed fluid ejections, obtainable on demand by altering the precise potential applied during the voltage pulse. A change of a few volts in the applied voltage altered the number of pulses obtained in each cycle from 1 to 3 during the 1 ms pulse time. Further increases in the voltage to 486V (not shown) results in 5 pulsations within the 1 ms applied voltage pulse; at higher voltages, the spray enters a continuous cone-jet for the length of the voltage pulse.

Figure 14:
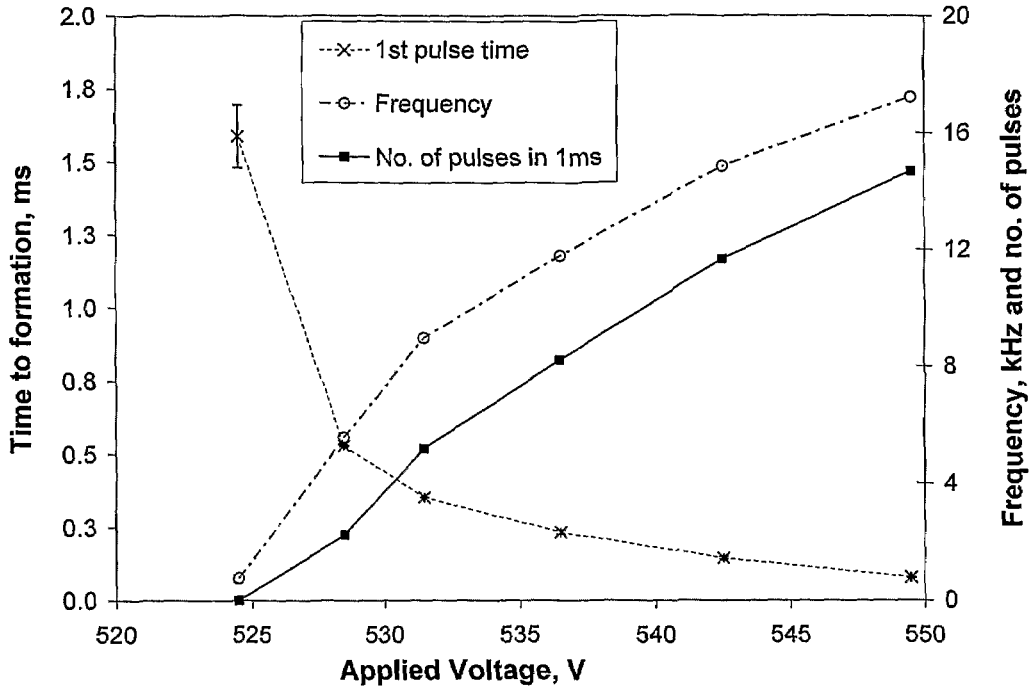
FIG. 14 is a plot of the effect of applied voltage on the pulse formation time, frequency and no. of pulses in a fixed time.

We have observed two main effects of the applied voltage on the pulsation characteristics. Firstly, the frequency of the pulsations increases with the voltage applied. Secondly, the start of the voltage pulse and the onset of pulsations is also a function of the magnitude of the voltage applied. The first of these two phenomena was characterised more thoroughly above for situations where the voltage is constant and the pulsations occur steadily at a fixed frequency. The data here is for the situation where the voltage is switched on only for a short period, forcing the spray to begin and then cease the pulsating spray mode. This data was obtained for TEG with the 4 μm needle held at a distance of 0.3 mm from the substrate. This relatively large distance reduced the strength of the electric field providing results that were less sensitive to setting errors on the voltage supply. Voltage pulses were applied for 9.5 ms duration to allow a large number of spray pulses to be obtained. FIG. 14 shows that the pulsation frequency increases with voltage and therefore more pulses can occur during a limited duration voltage pulse of say, 1 ms. This figure also shows that the elapsed time between the application of the voltage pulse and the first spray pulse is strongly affected by voltage, reducing as the voltage is increased. Since the first spray pulse occurs earlier for higher voltages, more spray pulses can occur in a limited time at higher voltage. These complimentary effects explain why an increase of just a few volts can produce the significant increase in the number of pulsations during a short voltage pulse.

The charge relaxation time of 6.4 ns is much shorter than the time between the first application of the potential and the onset of charge ejection. This suggests that processes other than the accumulation of charge on the surface are limiting the cone formation. The reason for the observed behaviour is thought to be that a stronger electric field exerts a larger electrical pressure on the charged surface of the liquid, this pressure works to deform the meniscus into a cone. The electrical pressure must overcome the meniscus surface tension and work against the inertia of the liquid and the viscous resistance to liquid flow through the capillary. A stronger electric field would then be expected to form the cone more rapidly. Research on liquid metal ion sources has shown that the formation time of a Taylor cone from a highly conducting liquid surface decreases as the voltage is increased. It was shown that viscosity rather than inertia was the dominant effect. However, in the case here, where a meniscus of organic solvent is initially unperturbed at the end of a hollow capillary, the change in volume required to form a Taylor cone is far greater; as a result inertia may become important.

5. Characterization of Deposited Liquid Volumes.

Three solvents: triethylene glycol, ethylene glycol, and water, all of varying conductivities, have been sprayed with the pulsed VMES technique. However, to demonstrate the patterning capability of the nanoelectrospray direct writing technique a commercially available printer ink was sprayed using a 4 μm glass capillary. This capillary was positioned at an appropriate distance above the surface of the target silicon substrate, typically 50 μm. The limited published information on this ink {Canon PGI5BK™ ink} identifies it as water with glycerin and diethylene glycol. We have measured other properties including a solid mass loading of ~10%, conductivity of ~0.4 S/m, density of 1010 kg/m$^3$ and surface tension of 38.4 mN/m.

The silicon target could be moved using a computer controlled linear translation stage; this provided positioning control for the sprayed droplets. Using a 5 ms voltage pulse duration at 1 Hz frequency the applied electrode potential was altered until the required number of fluid pulses per voltage cycle was obtained. The control approach adopted also included laying down a larger number of pulses at the first spray site, thus producing a large ink deposit. This deposit, clearly visible, could then be used subsequently to locate the deposition area for more ready characterisation by SEM microscopy. Following this initialization process, the silicon substrate was scanned over a distance of 210 μm at 14 μm/s to produce deposition sites nominally separated by 14 μm. It was found that if the number of pulses was too large or the separation between deposition sites too small, the deposited volumes coalesced into larger irregularly spaced deposits before the ink had dried. This may be due to the low absorbency of the silicon substrate.

An SEM image can show the accurate placement of deposits in a straight line. Each residue deposit in these images was as a result of 3 pulsations produced during the 5 ms duration in which a potential of −411V was applied to the substrate. The residues from these pulsations coalesce due to the small movement of the target during the "write-on" period. The higher magnification image of just two of these small residues sites illustrates the well-defined and reproducible nature of the deposits. As discussed for the TEG experiments higher voltages produce a larger number of pulsations; applying −427V gave 6 pulses during the voltage pulse. By allowing an increased number of pulses to occur over the same location in this way, larger deposits can be formed with a smooth topography, as shown in an AFM image.

An AFM image can show the results of traversing the substrate in two dimensions while allowing one to two pulses over each location. The ink deposits have an average size of 1.37 μm with a standard deviation of 0.29 μm. The actual distribution of the location errors may be observed in a 2D position nomogram. The average placement error for deposits was 2.86 μm with a standard deviation of 1.75 μm. No special precautions were taken to minimise disturbances to the apparatus, which was open and bench top mounted. We anticipate that the use of an anti-vibration table would reduce the placement errors. This patterning demonstrates the ability to control the absolute placement of the deposits in 2 dimensions.

The size of the deposited material can be used to provide an additional estimate of the liquid ejected during a pulse. The volume of material remaining on the surface, $V_r$, (the relic of the evaporated droplet) was first estimated by fitting an arc to the measured profile of the relic with a height, $h_r$, and radius, $r_r$, obtained by AFM.

The volume of the revolved arc is given by:

$$V_r = \pi\left(\frac{r_r^2 h_r}{2} + \frac{h_r^3}{6}\right).$$

Using this method the calculated volume of the relics range from 2.4 to $6.2\times10^{-20}$ $m^3$. Since the relics are mainly carbon pigment, using the density of solid carbon, at 2267 $kg.m^{-3}$, will set an upper limit to relic density, $\rho_r$. If we then use the measured liquid density, $\rho_d$ and solid mass fraction, $m_{solid}$, an estimate for the droplet volume itself may be made. For the relic data this volume, $$V_d = \frac{\rho_r V_r}{\rho_d m_{solid}},$$

identifies the volume of fluid ejected by the pulsations to lie in the range of 1.1 to 2.8 fL. If this ejected liquid formed a hemispherical droplet on the silicon before forming the residue, the initial diameter would lay in the range 1.6 to 2.2 μm. This is in good agreement with the measured residue, if it is assumed that the ink is well dispersed, prior to solvent evaporation. Analysis of the pulsation current waveforms obtained for this ink gives a spray current of ~50 nA and pulse duration of ~34 μs. The relative permittivity of this ink was not measured but if it is assumed to be less than 80 and follow the function of $f(\epsilon)$ then the volume ejected by a single pulse is estimated to lie between 0.9 and 1.33 fL. This is in good agreement with both the sizes of the relics seen and the estimated liquid volumes of the droplets before evaporation.

It was predicted that the volume ejected by a single pulse would decrease with the diameter of the nozzle used. It was predicted that using a nozzle with a diameter of 4 μm would result in pulses ejecting femtoliter volumes. The experimental results in which a 4 μm nozzle was used to deposit a pigment loaded ink, showed relics of 1 to 2 μm, consistent with droplet volumes estimated to be 1.1 to 2.8 fL. These results suggest some limited validity to equation (2) as a simple method of predicting the volume ejected by nanoelectrospray pulsations. Further support was presented from the volumes derived for a 115 μm nozzle using equation (1) and the in-line flowrate measurements, which were of the same order as the predictions of equation (2). However more nozzle sizes and liquids should be tested to fully assess the reliability of equation (2) for predicting pulse ejected volumes.

5. Conclusions

Whilst the deposition rate used in the present experiments is low at a few Hz, this is not due to limitations of the pulsating VMES mode, which exhibits frequencies in the high kHz range. The use of commercially available printer ink for this proof of concept deposition demonstrates the potential capability of voltage modulated electrosprays to pattern a silicon surface with high spatial resolution. The demonstration here, wherein 1 to 2 pulses form the residue, yielded a feature scale of 1.4±0.3 μm. This process thus achieves more than an order of magnitude decrease in the size of the deposits when compared to alternative direct writing methods such as those offered by the state of the art inkjet technology. Further, and advantageously, the liquid as dispensed is charged, thus potentially greater flexibility is offered by this technique to accurately position material on a target surface. Indeed, since the printer ink is pigment based these results demonstrate the suitability of VMES to deposit solid particle suspensions. We conclude that this novel approach to the dispensing of a femtoliter volume, in a drop-on-demand direct writing approach has the potential to be a viable alternative to ink-jet technology in many applications.

The invention claimed is:

1. An electrospray apparatus for dispensing a controlled volume of liquid as one or more electrospray pulses, the apparatus comprising:

an emitter having a spray area from which liquid can be sprayed, an electric field generator comprising at least two electrodes and a voltage power source connected to the electrodes, for applying an electric field to liquid in, on or adjacent to the emitter, whereby, in use, liquid is drawn to the spray area by electrostatic forces and one or more discrete pulses of electrospray are produced whilst a constant electric field is applied, wherein the amount of liquid in each electrospray pulse is dependant on any one or more of electric field strength, liquid viscosity, liquid conductivity and emitter geometry and independent of the time for which the constant electric field is applied.

2. An electrospray apparatus as claimed in claim 1 wherein the emitter comprises a cavity for receiving liquid, and the spray area is an aperture in fluid communication with the cavity.

3. An electrospray apparatus as claimed in claim 2 wherein the emitter is a tube.

4. An electrospray apparatus as claimed in claim 2 further comprising a reservoir for containing liquid, the reservoir connected to the cavity by a passageway.

5. An electrospray apparatus as claimed in claim 4 comprising a flow measuring device for monitoring flow of liquid to the emitter from the reservoir.

6. An elecrospray apparatus as claimed in claim 5 wherein the flow measuring device is for measuring the pressure drop between a pair of spaced apart pressure sensors.

7. An electrospray apparatus as claimed in claim 2 wherein the aperture has a diameter of between 0.1 and 500 μm.

8. An electrospray apparatus as claimed in claim 2 wherein the aperture has a diameter of between 0.1 and 50 μm.

9. An electrospray apparatus as claimed in claim 1 wherein the emitter is a surface having raised points, and the spray area is located on one or more of the raised points.

10. An electrospray apparatus as claimed in claim 1 wherein at least one electrode of the electric field generator is spaced apart from and aligned with the spray area, and at least one electrode of the electric field generator is engageable with the liquid.

11. An electrospray apparatus as claimed in claim 1 wherein a region is defined for containing a substrate spaced from the spray area, for the sprayed liquid to be deposited on a surface of the substrate, thereby forming a feature thereon.

12. An electrospray apparatus as claimed in claim 11 comprising means for providing relative movement between the substrate and the spray area.

13. An electrospray apparatus as claimed in claim 12 wherein the distance between the substrate and the spray area can be varied such that the size of the features formed on the substrate may be varied.

14. An electrospray apparatus as claimed in claim 12 wherein the relative movement between the substrate and the spray area is in a plane parallel to a plane of the substrate.

15. An electrospray apparatus as claimed in claim 11, wherein the substrate is to be coated with a pre-assembled monolayer of particles or molecules, and/or the substrate is coated with a pre-assembled sub-monolayer of particles or molecules.

16. An electrospray apparatus as claimed in claim 11, wherein the substrate is an insulator, or a semiconductor or a conductor.

17. An electrospray apparatus as claimed in claim 11, wherein the liquid contains a surface modifying material capable of altering the wetting properties of the substrate.

18. An electrospray apparatus as claimed in claim 11, wherein the substrate surface is porous or nonporous.

19. An electrospray apparatus as claimed in claim 1, wherein the volume of liquid ejected by a single pulse is between 0.1 femtoliter and 1 femtoliter, or between 1 femtoliter and 1 picoliter, or between 1 picoliter and 100 picolitres.

20. An electrospray apparatus as claimed in claim 1, wherein the total volume of liquid deposited by the successive ejection of multiple pulses is between 0.1 femtoliter and 0.1 picoliter, or between 0.1 picoliter and 1 nanoliter, or between 1 nanoliter and 1 microliter.

21. A method of electrospraying as claimed in claim 20, wherein the total volume of liquid deposited by the successive ejection of multiple pulses is between 0.1 femtoliter and 0.1 picoliter.

22. An electrospray apparatus as claimed in claim 1, wherein in use electrospray occurs at a frequency of between 1 kHz and 10 kHz, or between 1 Hz and 100 Hz, or between 10 kHz and 100 kHz, or between 100 Hz and 1000 Hz or between 100 kHz and 1 MHz.

23. An electrospray apparatus as claimed in claim 1, wherein in use the spray area is located within a second fluid that is immiscible or partially miscible with the liquid to be electrosprayed.

24. An electrospray apparatus as claimed in claim 23, wherein the second fluid is static or is a flowing phase.

25. An electrospray apparatus as claimed in claim 1, wherein the spray area is located in a housing arranged for containing any gaseous environment including, but not limited to, air, elevated pressure gas, vacuum, carbon dioxide, argon or nitrogen.

26. An electrospray apparatus as claimed in claim 1, wherein the emitter is one of a plurality of emitters, each emitter having a spray area, the electric field generator being operable to apply a constant electric field to liquid adjacent the spray area.

27. An electrospray apparatus as claimed in claim 26 wherein the emitters are arranged in an array.

28. An electrospray apparatus as claimed in claim 26, wherein the constant electric field generator is operable to independently control the electric field at each spray area.

29. An electrospray apparatus as claimed in claim 1 further comprising a fast switch connected to the electric field generator such that voltage is turned off or on by the fast switch to precisely control the time for which the electrospray apparatus ejects liquid.

30. An electrospray apparatus as claimed in claim 1, wherein the apparatus does not include a mechanical pump or any other means for pressurising the liquid.

31. A method of electrospraying, the method comprising:

applying a constant electric field of a selected strength to the liquid in, on or adjacent to at least one emitter having a spray area from which the liquid is sprayed, whereby liquid is drawn to the spray area by electrostatic forces, and one or more discrete pulses of electrospray are produced whilst the constant electric field is applied, wherein the amount of liquid in each electrospray pulse is dependent on any one or more of electric field strength, liquid viscosity, liquid conductivity and emitter geometry and independent of the time for which the constant electric field is applied, wherein the electric field strength, liquid viscosity and conductivity and emitter geometry are selected causing electrospray to occur in pulses at a constant frequency whilst the constant electric field is applied.

32. A method of electrospraying as claimed in claim 31 whereby liquid is drawn to the spray area without use of a mechanical pump or other means for pressurising the liquid.

33. A method of electrospraying as claimed in claim 31 wherein the emitter comprises a cavity for receiving liquid, and the spray area is an aperture in fluid communication with the cavity.

34. A method of electrospraying as claimed in claim 33 wherein the emitter is a tube.

35. A method of electrospraying as claimed in claim 31 wherein the emitter is a surface having raised points, and the spray area is located on one or more of the raised points.

36. A method of electrospraying as claimed in claim 31 wherein a plurality of emitters is provided, and the constant electric field applied to each emitter is independently controlled.

37. A method of electrospraying as claimed in claim 31 wherein a substrate is provided spaced from the spray area, the substrate receiving the sprayed liquid such that a feature is formed on the substrate.

38. A method of electrospraying as claimed in claim 37 wherein the liquid contains a surface modifying material capable of altering the wetting properties of the substrate.

39. A method of electrospraying as claimed in claim 38 wherein after the feature is formed on the substrate, fluid evaporates from the feature to allow the surface-modifying material to alter the wetting properties of the substrate surface at the location of the feature.

40. A method of electrospraying as claimed in claim 37 wherein there is relative movement between the substrate and the spray area such that the distance between the substrate and the spray area is varied.

* * * * *